US007605761B2

(12) United States Patent
Yanagisawa et al.

(10) Patent No.: US 7,605,761 B2
(45) Date of Patent: Oct. 20, 2009

(54) ANTENNA AND SEMICONDUCTOR DEVICE HAVING THE SAME

(75) Inventors: Makoto Yanagisawa, Ebina (JP); Takaaki Koen, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 11/979,990

(22) Filed: Nov. 13, 2007

(65) Prior Publication Data

US 2008/0129606 A1 Jun. 5, 2008

(30) Foreign Application Priority Data

Nov. 30, 2006 (JP) ..... 2006-324370

(51) Int. Cl.
*H01Q 1/38* (2006.01)
*H01Q 5/00* (2006.01)
*H01Q 9/04* (2006.01)

(52) U.S. Cl. ..... 343/700 MS; 343/741

(58) Field of Classification Search ..... 343/700 MS, 343/741, 702

See application file for complete search history.

(56) References Cited

U.S. PATENT DOCUMENTS 5,838,283 A 11/1998 Nakano
6,535,170 B2 * 3/2003 Sawamura et al. ..... 343/702
6,842,143 B2 * 1/2005 Otaka et al. ..... 343/700 MS
7,109,923 B2 * 9/2006 Ollikainen et al. .... 343/700 MS
7,215,293 B2 * 5/2007 Chen et al. ..... 343/741
7,271,769 B2 * 9/2007 Asano et al. ..... 343/702
7,280,074 B1 * 10/2007 Chi et al. ..... 343/700 MS
2005/0052334 A1 3/2005 Ogino et al.
2006/0202269 A1 9/2006 Suzuki et al.
2007/0222681 A1 * 9/2007 Greene et al. ..... 343/700 MS

FOREIGN PATENT DOCUMENTS

JP 08-195617 7/1996
JP 2000-059241 2/2000
JP 2005-102183 4/2005
JP 2005-244283 9/2005

* cited by examiner

*Primary Examiner*—Rexford N Barnie
*Assistant Examiner*—Crystal L Hammond
(74) *Attorney, Agent, or Firm*—Eric J. Robinson; Robinson Intellectual Property Law Office, P.C.

(57) ABSTRACT

An antenna capable of receiving circularly polarized waves and performing impedance matching between the antenna and an IC (integrated circuit) of a semiconductor device, and a semiconductor device having such an antenna. The antenna has a first conductor pattern with a loop configuration having a cut section, a second conductor pattern, a third conductor pattern, and a feeding section. A first end portion of the second conductor pattern and a first end portion of the third conductor pattern are connected to the first conductor pattern. A second end portion of the second conductor pattern and a second end portion of the third conductor pattern are connected to the feeding section. The total length of the second conductor pattern is longer than the total length of the third conductor pattern, and the second conductor pattern is placed closer to the cut section than the third conductor pattern is.

18 Claims, 18 Drawing Sheets

ANTENNA AND SEMICONDUCTOR DEVICE HAVING THE SAME

BACKGROUND OF THE INVENTION

1. Field of the Invention

The present invention relates to an antenna capable of receiving circularly polarized waves and a semiconductor device having such an antenna.

2. Description of the Related Art

In recent years, RFID (radio frequency identification) systems have been researched and put into practical use.

RFID refers to a communication technology over electromagnetic waves between a reader/writer and a semiconductor device capable of wireless data transmission and reception (also called an RFID tag, ID tag, IC tag, IC chip, wireless tag, electronic tag, or wireless chip), so that data can be stored in or read from the semiconductor device. Such a semiconductor device has an antenna and an IC (integrated circuit) with a memory circuit, a signal processing circuit, and the like. As an antenna used for a semiconductor device, a dipole antenna, a folded dipole antenna, or the like is frequently used because of its simple structure.

Meanwhile, it is known that when a linear antenna such as a dipole antenna is provided in a semiconductor device and if the direction of polarized waves received by the linear antenna greatly differs from the direction of polarized waves transmitted from an antenna provided in a reader/writer, there arises a great loss of polarized waves. Therefore, considering the circumstance that such a semiconductor device is used while being attached to another object, the direction of attachment is undesirably restricted.

In order to solve the foregoing problem, an antenna capable of transmitting circularly polarized waves is often used as a transmission antenna of a reader/writer. Accordingly, communication can be performed regardless of the direction of polarized waves that can be received by a reception antenna. However, when a linear antenna receives electromagnetic waves from a transmission antenna that can transmit circularly polarized waves, there is a 3 dB loss of circularly polarized waves (e.g., Reference 1: Klaus Finkenzeller, *RFID Handbook,* 2nd Edition, The Nikkan Kogyo Shimbun, Ltd., May 2004, pp. 98-99). When there is such a loss of circularly polarized waves, electricity received by the semiconductor device decreases and, therefore, a communication distance between the reader/writer and the semiconductor device decreases. Thus, it is desired to reduce the loss of circularly polarized waves.

As an antenna suited to receiving circularly polarized waves, there are known antennas disclosed in Reference 2 (Japanese Published Patent Application No. H8-195617) and Reference 3 (Japanese Published Patent Application No. 2000-59241). These antennas are C-shaped loop elements having a dielectric substrate and a cut section and provided over the dielectric substrate. The C-shaped loop element is disposed so as to be opposite a ground plane with a predetermined interval therebetween.

Further, as a thin antenna capable of receiving circularly polarized waves, there has been developed an antenna which is a combination of a loop antenna and a parasitic element disposed outside the loop antenna (e.g., Reference 4: Japanese Published Patent Application No. 2005-102183).

For a typical antenna, a cable having an intrinsic impedance of 50Ω is used for feeding electricity, and a matching circuit is disposed between the cable and the antenna to perform impedance matching. When sufficient impedance matching is not performed, electricity received by the antenna is reflected by the input of the antenna, in which case electricity fed from the cable cannot be delivered to the antenna. As for a semiconductor device capable of wireless data transmission and reception, electricity is fed without using a cable or the like, but by directly connecting an antenna and an IC that constitute the semiconductor device. However, when there is an impedance mismatch between the antenna and the IC, electricity required to operate the IC may not be supplied from the antenna, in which case the semiconductor device cannot operate. Therefore, impedance matching between the antenna and the IC that constitute the semiconductor device is of great importance.

In addition, for a semiconductor device that wirelessly transmits and receives data, it is preferable to perform impedance matching without using a matching circuit in terms of cost saving and the like (e.g., Reference 5: Japanese Published Patent Application No. 2005-244283).

SUMMARY OF THE INVENTION

However, for the antennas disclosed in Reference 2 and Reference 3, which receive circularly polarized waves, it is necessary to leave a predetermined interval between the antenna conductor portion and the ground plane. Therefore, when such an antenna is provided in a semiconductor device, the thickness of the semiconductor device increases, resulting in cost increase and limited use applications. Further, when a thin antenna capable of receiving circularly polarized waves that is disclosed in Reference 4 or the like is provided in a semiconductor device, a matching circuit should be provided because the antenna does not have a structure with which impedance matching between the antenna and the IC can be performed.

In view of the foregoing problems, an object of the invention is to provide an antenna capable of receiving circularly polarized waves and performing impedance matching between the antenna and an IC (integrated circuit) of a semiconductor device, and a semiconductor device having such an antenna.

The invention solves the abovementioned problems by providing an antenna with which loss of circularly polarized waves can be reduced, and which performs impedance matching between the antenna and an IC of a semiconductor device.

One aspect of the invention is an antenna which includes: a first conductor pattern having a loop configuration with a cut section, and a second conductor pattern and a third conductor pattern connected to the first conductor pattern with the loop configuration. The second conductor pattern and the third conductor pattern are electrically connected to a feeding section. In the invention, "the feeding section" is a portion which feeds electricity to the antenna, and receives/outputs electricity and signals from/to an external portion. The total length of the second conductor pattern is longer than the total length of the third conductor pattern, and the second conductor pattern is placed closer to the cut section than the third conductor pattern is.

According to one aspect of the antenna of the invention, assuming that the total length of the first conductor pattern is L, the feeding section is provided in a position whose distance from the cut section is in the range of L/6 to L/4. Note that the position where the feeding section is provided as mentioned herein is determined so that the feeding section is provided on the conductor pattern positioned closest to the middle point between end portions of the second conductor pattern and the third conductor pattern, to which the feeding section is electrically connected.

One aspect of the invention is an antenna which includes: a first conductor pattern, a second conductor pattern, a third conductor pattern, and a feeding section having a first terminal and a second terminal that are formed over a substrate. A first end portion of the first conductor pattern is connected to the second conductor pattern; a second end portion of the first conductor pattern is connected to the third conductor pattern; a first end portion of the second conductor pattern is electrically connected to the first terminal of the feeding section; a first end portion of the third conductor pattern is electrically connected to the second terminal of the feeding section; a second end portion of the second conductor pattern and a second end portion of the third conductor pattern are insulated; a conductor pattern made of the second conductor pattern and the third conductor pattern that are electrically connected through the feeding section has a loop configuration; the total length of the third conductor pattern is longer than the total length of the second conductor pattern; and a distance from a connection portion of the first conductor pattern and the second conductor pattern to the first end portion of the second conductor pattern is longer than a distance from a connection portion of the first conductor pattern and the third conductor pattern to the first end portion of the third conductor pattern. In addition, assuming that the total length of the second conductor pattern is $L_2$, the total length $L_3$ of the third conductor pattern can be $3L_2$ to $5L_2$.

One aspect of the invention is a semiconductor device which includes: an integrated circuit having a first terminal and a second terminal, and an antenna electrically connected to the integrated circuit. The antenna includes a first conductor pattern, a second conductor pattern, and a third conductor pattern are formed over a substrate; the first conductor pattern has a loop configuration with a cut section; a first end portion of the second conductor pattern and a first end portion of the third conductor pattern are connected to the first conductor pattern; a second end portion of the second conductor pattern is electrically connected to the first terminal of the integrated circuit; a second end portion of the third conductor pattern is electrically connected to the second terminal of the integrated circuit; the total length of the second conductor pattern is longer than the total length of the third conductor pattern; and the second conductor pattern is placed closer to the cut section than the third conductor pattern is. In addition, assuming that the total length of the first conductor pattern is L, the integrated circuit can be provided in a position whose distance from the cut section is in the range of L/6 to L/4.

One aspect of the invention is a semiconductor device which includes: an integrated circuit having a first terminal and a second terminal, and an antenna electrically connected to the integrated circuit. The antenna includes a first conductor pattern, a second conductor pattern, and a third conductor pattern that are formed over a substrate; a first end portion of the first conductor pattern is connected to the second conductor pattern; a second end portion of the first conductor pattern is connected to the third conductor pattern; a first end portion of the second conductor pattern is electrically connected to the first terminal of the integrated circuit; a first end portion of the third conductor pattern is electrically connected to the second terminal of the integrated circuit; a second end portion of the second conductor pattern and a second end portion of the third conductor pattern are insulated; a conductor pattern made of the second conductor pattern and the third conductor pattern that are electrically connected through the integrated circuit has a loop configuration; the total length of the third conductor pattern is longer than the total length of the second conductor pattern; and a distance from a connection portion of the first conductor pattern and the second conductor pattern to the first end portion of the second conductor pattern is longer than a distance from a connection portion of the first conductor pattern and the third conductor pattern to the first end portion of the third conductor pattern. In addition, assuming that the total length of the second conductor pattern is $L_2$, the total length $L_3$ of the third conductor pattern can be $3L_2$ to $5L_2$.

According to one aspect of the semiconductor device of the invention, the integrated circuit can be provided with a battery that is wirelessly chargeable from outside.

Note that in the invention, the description "connected" includes both "electrically connected" and "directly connected". Therefore, in the configuration disclosed by the invention, other elements that enable electrical connection (e.g., a switch, transistor, capacitor, inductor, resistor, or diode) may be disposed between elements having a predetermined connection relationship. Otherwise, such elements may be directly connected without interposing other elements therebetween.

Using the antenna of the invention that is capable of receiving circularly polarized waves makes it possible to reduce loss of circularly polarized waves that occurs when an RF tag receives circularly polarized electromagnetic waves transmitted from a reader/writer. Further, since the antenna of the invention has a structure with which impedance matching between the antenna and an IC (integrated circuit) that constitute an RF tag can be performed, there is no need to provide a matching circuit that is typically interposed between the antenna and a feed line. Therefore, reduction in size and cost can be achieved. In addition, since the antenna of the invention can be formed in a single plane, reduction in thickness of the semiconductor device can be easily achieved, and thus such a semiconductor device can be provided to various objects.

DETAILED DESCRIPTION OF THE INVENTION

Figure 1A:
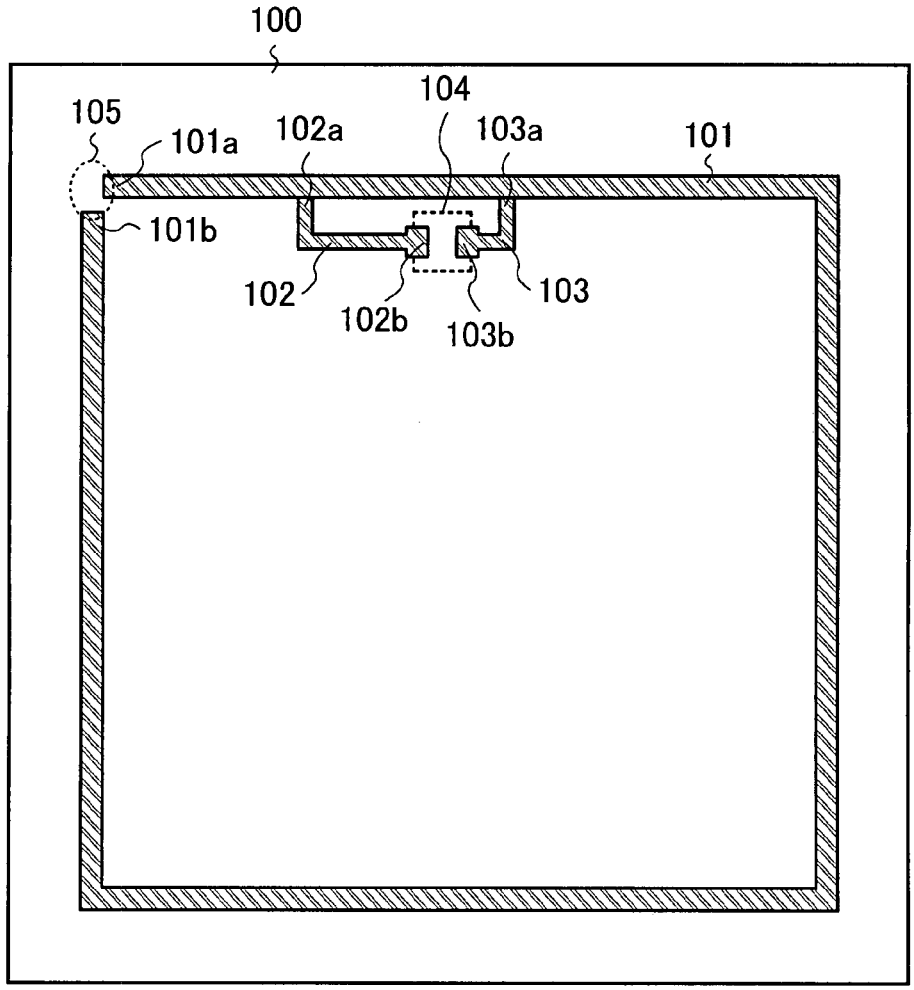
FIGS. 1A and 1B illustrate an exemplary antenna of the invention.

Embodiment modes and embodiments of the invention will be hereinafter described with reference to the accompanying drawings. Note that the invention can be implemented in various different ways and it will be easily understood by those skilled in the art that various changes and modifications can be made in the invention without departing from the spirit and scope thereof. Therefore, the invention should not be construed as being limited to the description in the following embodiment modes and embodiments. In the accompanying drawings, like portions or portions having like functions are denoted by like reference numerals, and repetitive description thereof will be omitted.

Generally, antennas can be used for both transmission and reception of electromagnetic waves. For ease of description, the following embodiment modes illustrate only cases where an antenna receives electromagnetic waves, and a case where an antenna transmits electromagnetic waves will be omitted. However, it is obvious that the antenna of the invention can also transmit electromagnetic waves.

Embodiment Mode 1

This embodiment mode will describe an exemplary antenna of the invention with reference to the drawings.

An antenna shown in this embodiment mode includes a substrate 100, conductor patterns 101 to 103, a feeding section 104, and a cut section 105 (see FIG. 1A). Here, the conductor pattern 101 is arranged in a loop configuration with the cut section 105, whereby the antenna can effectively receive circularly polarized waves from outside. In addition, the conductor patterns 102 and 103 are connected to the conductor pattern 101, and end portions of the conductor patterns 102 and 103 are connected to terminals of the feeding section 104, whereby impedance of the antenna is controlled. Hereinafter, a specific structure of the antenna will be described in detail.

The conductor patterns 101 to 103 are provided over the substrate 100. As the substrate 100, a dielectric substrate such as glass, epoxy resin, fluorine resin, ceramic, polyethylene terephthalate (PET), polyethylene naphthalate (PEN), polyethersulfone (PES), acrylic, or paper can be used. The conductor patterns 101 to 103 can be formed in, for example, a linear shape.

Figure 6A:
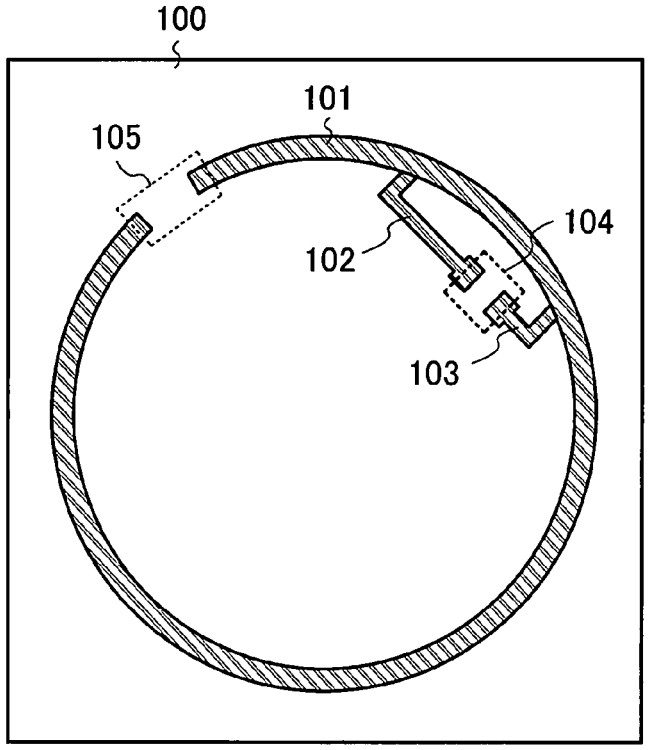
FIGS. 6A and 6B illustrate exemplary antennas of the invention.
Figure 6B:
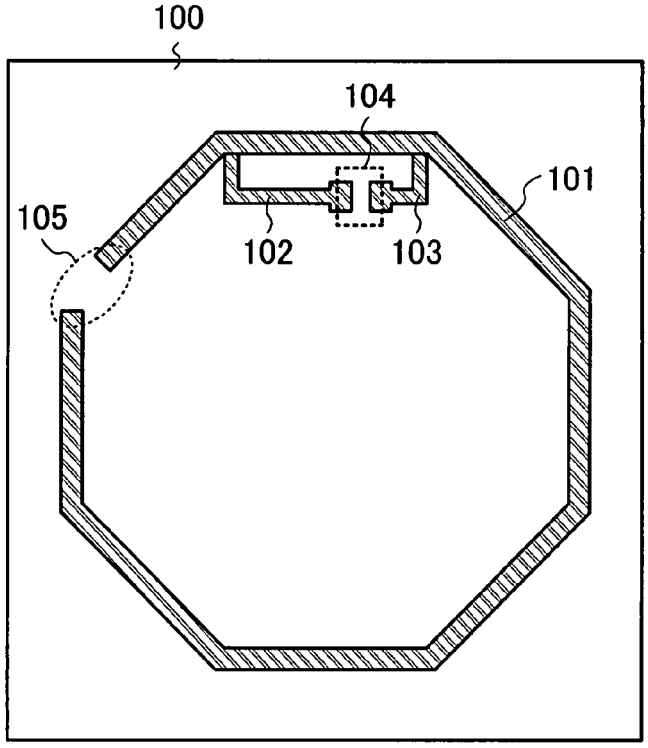

The conductor pattern 101 is arranged in a loop configuration with the cut section 105, and has two end portions: a first end portion 101*a* and a second end portion 101*b*. Although this embodiment mode illustrates the case where the conductor pattern 101 is a square, one of vertices of which lacks at the cut section 105, the shape of the conductor pattern 101 is not limited to the square that is partially cut, and it may be a circular shape that is partially cut (C-shaped loop) (see FIG. 6A) or a polygonal shape that is partially cut (see FIG. 6B). Although FIG. 6B illustrates the conductor pattern 101 with a partially cut octagonal shape, the shape of the conductor pattern 101 is not limited thereto.

The conductor pattern 102 has two end portions: a first end portion 102*a* and a second end portion 102*b*, and the first end portion 102*a* is electrically connected to the conductor pattern 101. The conductor pattern 103 has two end portions: a first end portion 103*a* and a second end portion 103*b*, and the first end portion 103*a* is electrically connected to the conductor pattern 101. In addition, the feeding section 104 is provided so as to be electrically connected to the conductor patterns 102 and 103. The feeding section 104 has two terminals: a first terminal and a second terminal. The first terminal of the feeding section 104 is electrically connected to the second end portion 102*b* of the conductor pattern 102, and the second terminal of the feeding section 104 is electrically connected to the second end portion 103*b* of the conductor pattern 103. For example, by providing an IC chip so as to be electrically connected to the second end portion 102*b* of the conductor pattern 102 and the second end portion 103*b* of the conductor pattern 103, a semiconductor device capable of wireless data transmission and reception can be constructed. Although this embodiment mode illustrates the example where the conductor patterns 102 and 103 are provided in an L shape, the shapes of the conductor patterns 102 and 103 are not limited thereto.

Note that in the case where the conductor patterns 101 to 103 are formed with the same material and at the same time, potions protruding from the loop conductor pattern 101 correspond to the conductor patterns 102 and 103 in FIG. 1A. That is, in the case where the conductor patterns 101 to 103 are formed with the same material, they can be regarded as one conductor pattern having a first portion (which corresponds to the conductor pattern 101), a second portion (which corresponds to the conductor pattern 102), and a third portion (which corresponds to the conductor pattern 103).

The conductor patterns 101 to 103 can be provided by using conductive materials such as copper (Cu), aluminum (Al), silver (Ag), and gold (Au).

Figure 1B:
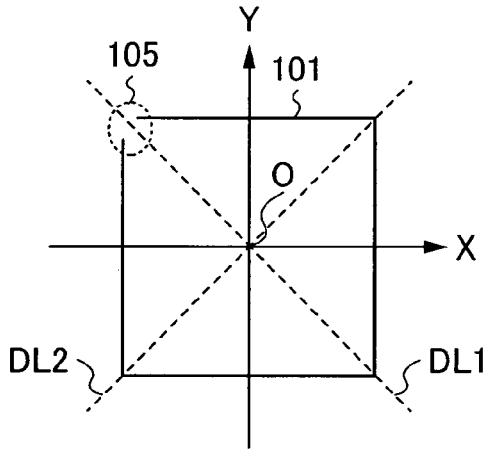

Next, FIG. 1B shows the relationship between the conductor pattern 101 and the cut section 105. When the conductor pattern 101 is provided to be a square, one of vertices of which lacks at the cut section 105, the cut section 105 may be provided in a part of any one of the four sides. For example, an intersection of a first diagonal DL1 and a second diagonal DL2 that connect opposite vertices of the conductor pattern 101 is represented by the origin O. Then, an X axis and a Y axis are determined by drawing lines from the origin O to the four sides of the conductor pattern 101 so as to cross them at right angles. At this time, the cut section 105 is disposed so that sides of the conductor pattern 101 that are parallel with the Y axis and sides of the conductor pattern 101 that are parallel with the X axis are present in each of the first to fourth quadrants that are determined by the X axis and the Y axis.

In the antenna shown in this embodiment mode, the conductor patterns 102 and 103 are provided to control the input impedance of the antenna. Assuming that the length of the conductor pattern 102 is D1 and the length of the conductor pattern 103 is D2, the input impedance of the antenna depends on the sum (D0) of D1 and D2. The input impedance of the antenna can be controlled by changing the lengths of the conductor patterns 102 and 103. In the antenna shown in this embodiment mode, the conductor patterns 102 and 103 are provided such that D1 and D2 differ from each other. Specifically, one of the conductor patterns 102 and 103 which is disposed in a position closer to the end portion of the conductor pattern 101 is formed to be longer. Here, a configuration is shown in which the conductor pattern 102 is formed to be longer than the conductor pattern 103 because a distance between the first end portion 101*a* of the conductor pattern 101 and the first end portion 102*a* of the conductor pattern 102 is shorter than the distance between the second end portion 101*b* of the conductor pattern 101 and the first end portion 103*a* of the conductor pattern 103. Note that the length D1 of the conductor pattern 102 is a distance between the first end portion 102*a* and the second end portion 102*b* of the conductor pattern 102 which is arranged linearly. Similarly, the length D2 of the conductor pattern 103 is a distance between the first end portion 103*a* and the second end portion 103*b* of the conductor pattern 103 which is arranged linearly.

In this manner, when the conductor pattern having a loop configuration with a cut portion is provided with the conductor patterns 102 and 103 for controlling the impedance of the antenna, and one of the conductor patterns 102 and 103 which is disposed in a position closer to the end portion of the conductor pattern 101 is formed to be longer, impedance matching between the antenna and an IC (integrated circuit) can be accomplished, whereby electricity supplied to the feeding section 104 can be increased.

Next, the position of the feeding section 104 will be described. Here, the position of the feeding section 104 will be described on the assumption that the conductor pattern 101 having a loop configuration with a cut portion is a straight line.

Referring again to FIG. 1A, when the conductor pattern 101 shown as a square with the cut section 105 is arranged linearly, the conductor pattern 101 can be regarded as one straight line. Then, a point of the conductor pattern 101 that is positioned closest to the middle point between the second end portion 102*b* of the conductor pattern 102 and the second end portion 103*b* of the conductor pattern 103 is represented by a point 101*c* (see FIG. 2A). Here, the point 101*c*, which is an intersection of the conductor pattern 101 and a line perpendicular to the conductor pattern 101 that is drawn from the center of the feeding section 104, is used as a reference position in providing the feeding section 104. In this case, the conductor pattern 101 can be assumed to have conductor patterns 111*a* and 111*b* divided by the point 101*c* (see FIG. 2B).

With the above assumption in mind, when the total length of the conductor patterns 111*a* and 111*b* (the length of the conductor pattern 101) is represented by L, the antenna shown in this embodiment mode is provided with the feeding section 104 such that one of the conductor patterns 111*a* and 111*b* has a length of L/6 to L/4. In FIG. 2B, the conductor pattern 111*a* is provided to be shorter than the conductor pattern 111*b*, and the feeding section 104 is disposed such that the conductor pattern 111*a* has a length of L/6 to L/4. By disposing the feeding section 104 in such position, a loss of circularly polarized waves can be reduced, and electricity received by the antenna can be increased. Note that the length of the conductor pattern 111*a* is a distance between the first end portion 101*a* and the point 101*c* of the linear conductor pattern 101. Similarly, the length of the conductor pattern 111*b* is a distance between the second end portion 101*b* and the point 101*c* of the linear conductor pattern 101 (see FIG. 2B).

Assuming that the wavelength of electromagnetic waves received by the antenna is λ, the length L of the conductor pattern 101 is preferably about 0.8λ to 2λ. This is because such a range allows reduction in loss of circularly polarized waves and increase in gain of the antenna.

Figure 3A:
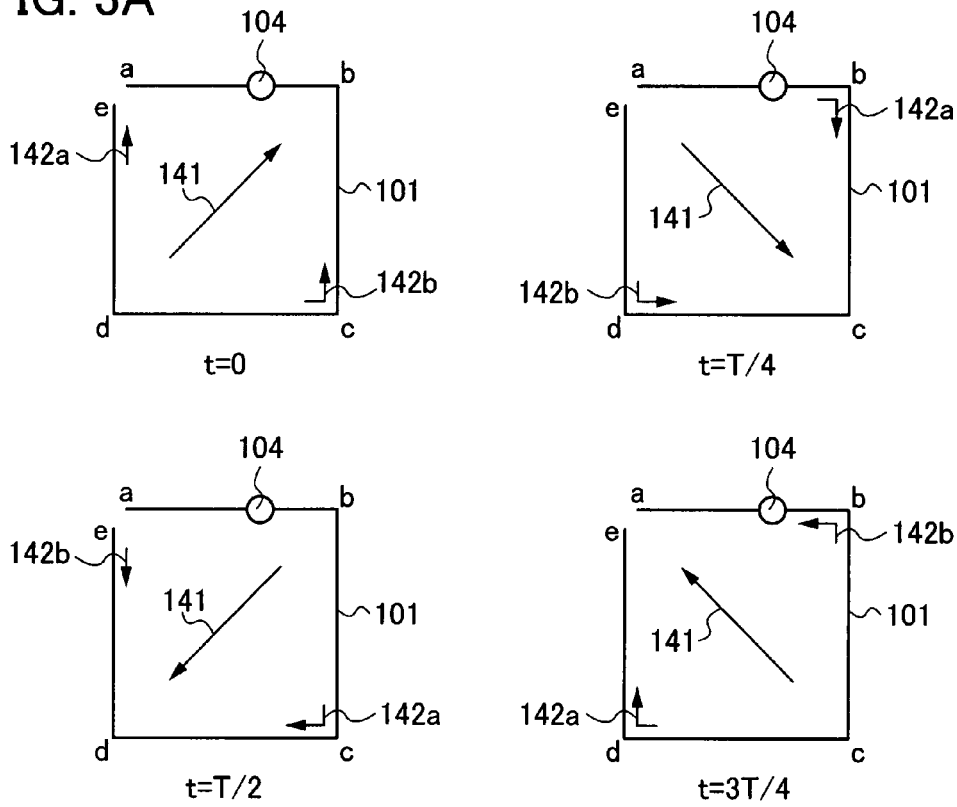
FIGS. 3A and 3B illustrate the operation of the antenna of the invention in each time when the antenna receives circularly polarized waves.

Next, the operation of the above-described antenna will be described. An electric field of a circularly polarized wave changes periodically. Thus, in an antenna that receives circularly polarized waves, the direction of current generated through the antenna periodically changes due to the electric field. FIG. 3A shows the direction of an electric field and the direction of current flowing through the conductor pattern 101 of the antenna per T/4[s] (where T[s] represents the period of an electromagnetic wave received by the antenna) when an electromagnetic wave enters in the direction perpendicular to the plane of the antenna. The first end portion 101*a* of the conductor pattern 101 is denoted by "a" while the second end portion 101*b* of the conductor pattern 101 is denoted by "e". Vertices of the conductor pattern 101 that bend at right angles are denoted by "b", "c", and "d". An arrow 141 indicates the direction of an electric field at a given time, while arrows 142*a* and 142*b* indicate portions where a large current is generated and the directions of the current flow at a given time.

Figure 2A:
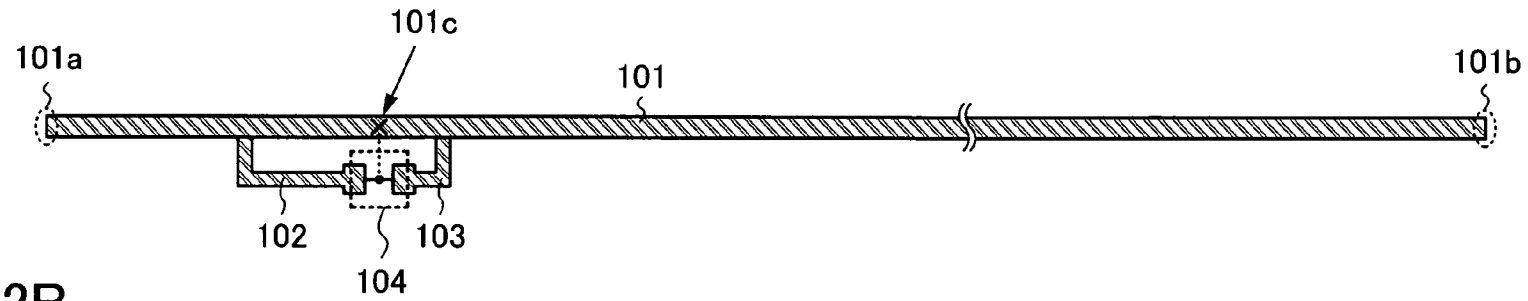
FIGS. 2A and 2B illustrate the position of a feeding section in the antenna of the invention.
Figure 2B:
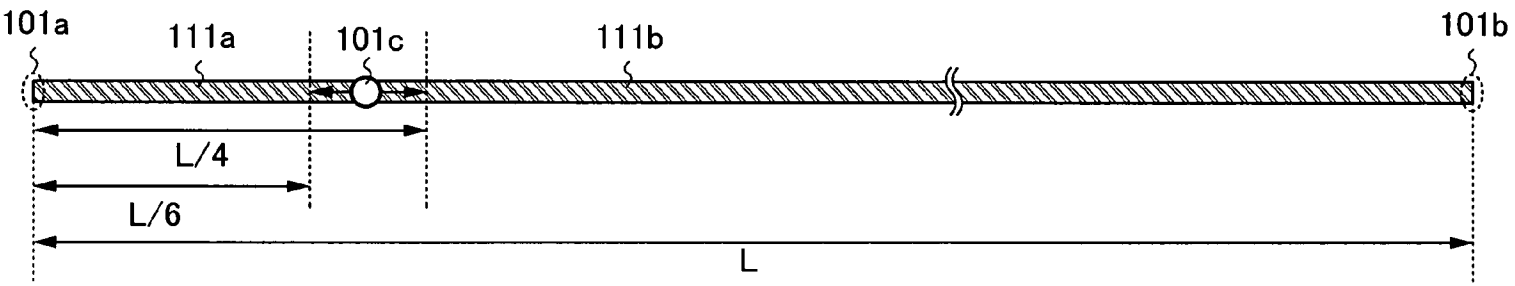
Figure 3B:
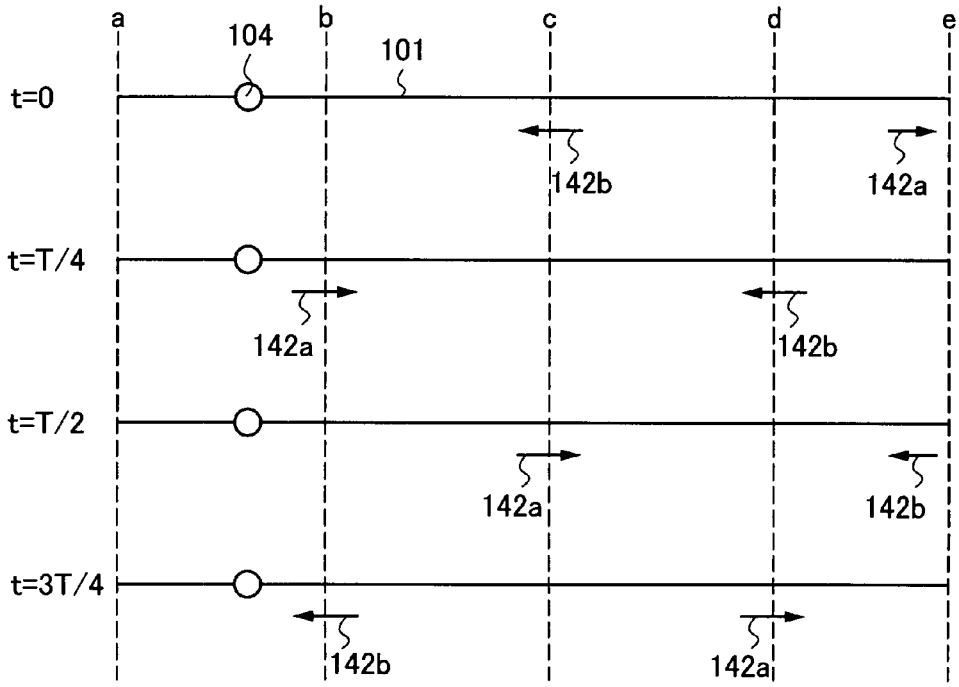

FIG. 3B shows a current flow through the antenna on the assumption that the vertices of the conductor pattern 101 that bend at right angles and the like are arranged linearly, like FIGS. 2A and 2B. Specifically, FIG. 3B shows a portion where a large current is generated and how the direction of a current flow changes at each time shown in FIG. 3A. When t=0[s], a right-pointing arrow 142*a* is located at e of the conductor pattern. Thereafter, the arrow sequentially moves to the right, in other words, from b to c and d per T/4[s]. Similarly, a left-pointing arrow 142*b* sequentially moves to the right, in other words, from c to d, e, and b. In this manner, the direction of a current flow through the antenna of this embodiment mode changes periodically, whereby the antenna can receive circularly polarized waves.

As per above, the use of the antenna shown in this embodiment mode allows reduction in loss of circularly polarized waves upon reception of electromagnetic waves transmitted from a reader/writer. Further, when the antenna shown in this embodiment mode is applied to a semiconductor device that wirelessly transmits and receives data, reduction in size and cost can be achieved because there is no need to separately provide a matching circuit as the impedance matching between the antenna and the feeding section (e.g., an IC chip) can be accomplished.

Embodiment Mode 2

This embodiment mode will describe an antenna which differs from the antenna shown in the preceding embodiment mode, with reference to the drawings.

Figure 5:
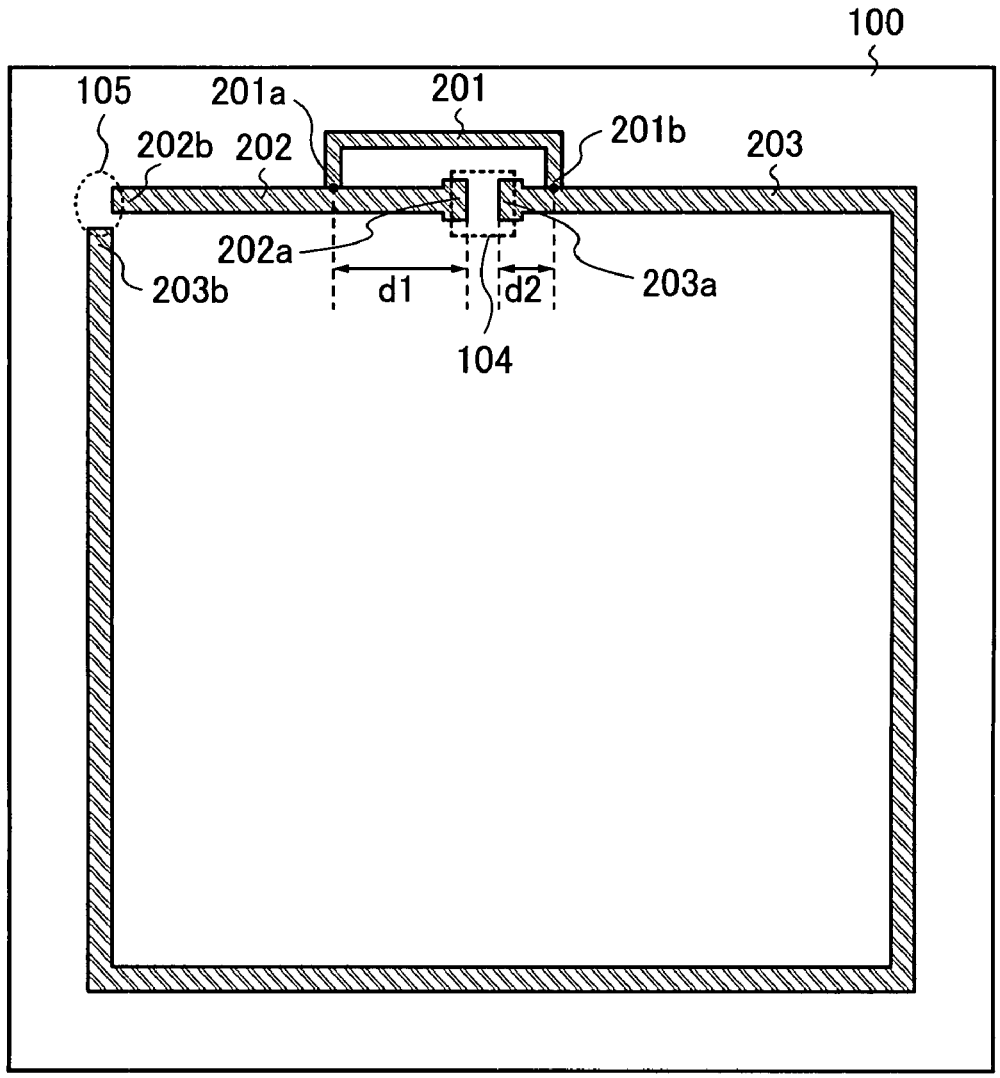
FIG. 5 illustrates an exemplary antenna of the invention.

An antenna shown in this embodiment mode includes the substrate 100, conductor patterns 201 to 203, the feeding section 104, and the cut section 105 (see FIG. 5). Here, the conductor patterns 202 and 203 are each connected to the two terminals of the feeding section 104, and a conductor pattern made of the conductor patterns 202 and 203 is arranged in a loop configuration with the cut section 105, whereby the antenna can effectively receive circularly polarized waves from outside. In addition, the conductor pattern 201 is connected to the conductor patterns 202 and 203, whereby the impedance of the antenna is controlled. Hereinafter, a specific structure of the antenna will be described in detail.

The conductor pattern 201 has two end portions: a first end portion 201*a* and a second end portion 201*b*, and the first end portion 201*a* is connected to the conductor pattern 202 while the second end portion 201*b* is connected to the conductor pattern 203. In addition, the conductor pattern 201 is disposed so as to bypass the feeding section 104 connected to a first end portion 202*a* of the conductor pattern 202 and a first end portion 203*a* of the conductor pattern 203 (see FIG. 5).

The conductor pattern 202 has two end portions: the first end portion 202*a* and a second end portion 202*b*, and the first end portion 202*a* is electrically connected to the first terminal of the feeding section 104 while the second end portion 202*b* is electrically insulated. The conductor pattern 203 has two end portions: a first end portion 203*a* and a second end portion 203*b*, and the first end portion 203*a* is electrically connected to the second terminal of the feeding section 104 while the second end portion 203*b* is electrically insulated.

Assuming that the distance from the connection point of the first end portion 201*a* of the conductor pattern 201 and the conductor pattern 202 to the first end portion 202*a* of the conductor pattern 202 is represented by d1, and the distance from the connection point of the second end portion 201*b* of the conductor pattern 201 and the conductor pattern 203 to the first end portion 203*a* of the conductor pattern 203 is represented by d2, the feeding section 104 is provided such that d1>d2 is satisfied. When d1>d2 is satisfied, impedance matching between the antenna and an IC (integrated circuit) can be accomplished, whereby a large amount of electricity can be supplied to the feeding section 104.

The total length $L_3$ of the conductor pattern 203 is set longer than the total length $L_2$ of the conductor pattern 202. Specifically, the total length $L_3$ of the conductor pattern 203 is preferably $3L_2$ to $5L_2$. By providing the conductor patterns 202 and 203 so as to satisfy the above relationship and providing the feeding section 104 so as to be connected to the first end portions of the conductor patterns 202 and 203, a loss of circularly polarized waves can be reduced and electricity received by the antenna can be increased.

As per above, the use of the antenna shown in this embodiment mode allows reduction in loss of circularly polarized waves upon reception of electromagnetic waves transmitted from a reader/writer. Further, when the antenna shown in this embodiment mode is applied to a semiconductor device that wirelessly transmits and receives data, reduction in size and cost can be achieved because there is no need to separately provide a matching circuit as the impedance matching between the antenna and the feeding section (e.g., an IC chip) can be accomplished.

Embodiment Mode 3

Figure 7A:
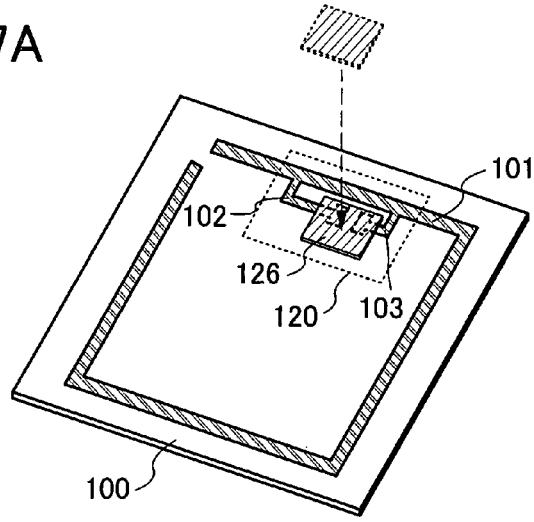
FIGS. 7A to 7C illustrate a semiconductor device having the antenna of the invention.
Figure 7B:
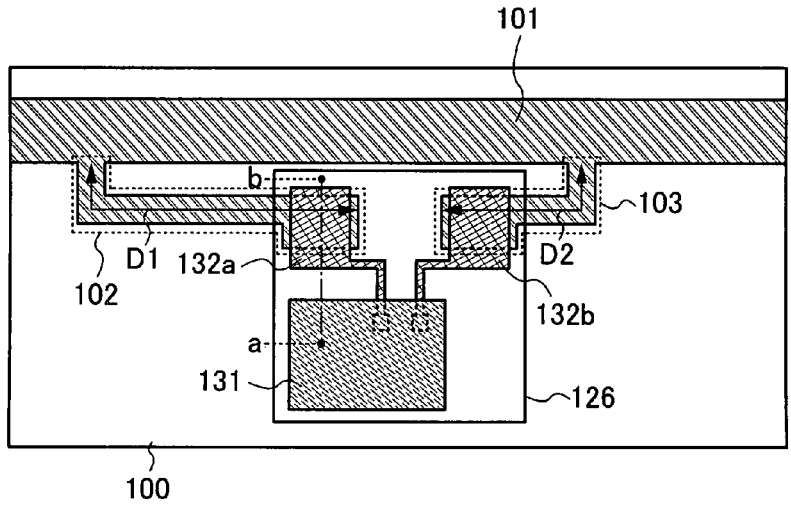
Figure 7C:
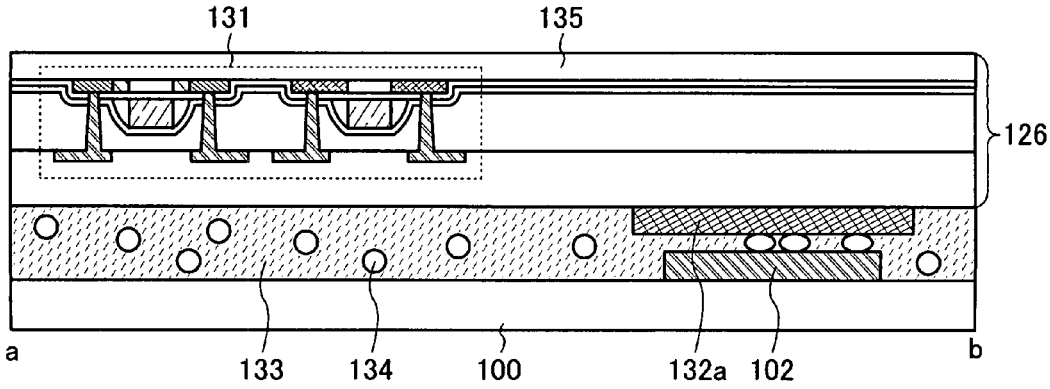

This embodiment mode will describe a semiconductor device having the antenna shown in the above embodiment mode, with reference to FIGS. 7A to 7C. Specifically, description will be made of the case where a semiconductor device is formed by attaching an element layer (also called an IC chip) having elements such as transistors to the antenna shown in the above embodiment mode. FIG. 7B is an enlarged view of a region 120 in FIG. 7A, and FIG. 7C is a cross-sectional view along line a-b of FIG. 7B.

First, the conductor patterns 101 to 103 functioning as antennas are formed over the substrate 100. Here, a case is shown in which the conductor patterns 101 to 103 are formed with the same material and at the same time. Meanwhile, an element layer 126 having elements such as transistors is formed separately from the antenna. For the antenna, an antenna with any configuration of the invention may be employed. The element layer 126 includes an integrated circuit portion 131 having elements such as transistors and conductive films 132*a* and 132*b* electrically connected to the integrated circuit portion 131 (FIG. 7B).

Next, the element layer 126 is attached to the substrate 100 (FIG. 7A). The element layer 126 is attached to the substrate 100 so that the conductor patterns 102 and 103 formed over the substrate 100 are electrically connected to the conductive films 132*a* and 132*b* formed in the element layer 126, respectively. Here, a case is shown in which an anisotropic conductive film is used for attaching the element layer 126 to the substrate 100 (FIG. 7C), and the element layer 126 is attached to the substrate 100 using an adhesive resin 133. In addition, the conductor patterns 102 and 103 are electrically connected to the conductive films 132*a* and 132*b*, respectively, using conductive particles 134 contained in the resin 133. Attachment of the element layer 126 to the substrate 100 may also be carried out with a conductive adhesive such as silver paste, copper paste, or carbon paste, by reflow soldering, or the like.

Thin film transistors (TFTs) may be provided in the integrated circuit portion 131 of the element layer 126. In this case, a glass substrate or a plastic substrate may be used as a substrate 135 of the element layer 126. Alternatively, it is also possible to use a semiconductor substrate such as silicon (Si) for the substrate 135 and form transistors whose channel regions are provided in the semiconductor substrate, so that the integrated circuit portion 131 can be constructed from the transistors.

The semiconductor device of this embodiment mode may employ the structures of an antenna, the method of fabricating a semiconductor device, and the like that are shown in other embodiment modes of this specification.

Embodiment Mode 4

This embodiment mode will describe a method of fabricating the semiconductor device shown in Embodiment Mode 3, with reference to the drawings. Here, description will be made of the case where an element layer is formed by providing elements such as transistors over a flexible substrate.

Figure 8A:
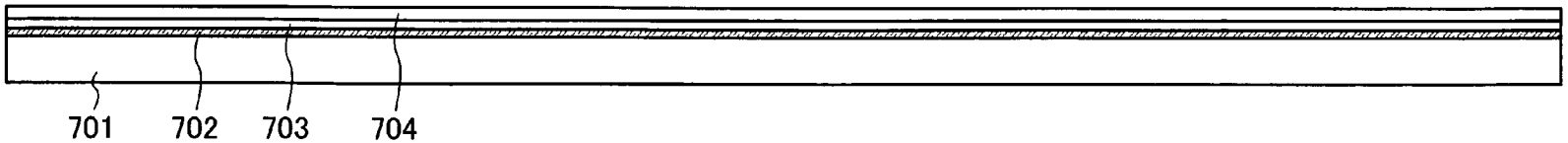
FIGS. 8A to 8D illustrate a method of fabricating the semiconductor device of the invention.

First, a release layer 702 is formed over a surface of a substrate 701. Then, a base insulating film 703 and an amorphous semiconductor film 704 (e.g., a film containing amorphous silicon) are formed thereover (FIG. 8A). Note that the release layer 702, the base insulating film 703, and the amorphous semiconductor film 704 can be formed consecutively.

The substrate 701 may be a glass substrate, a quartz substrate, a metal substrate or a stainless steel substrate that has an insulating film formed over its surface, a thermally stable plastic substrate that can withstand the processing temperature during the fabrication process, or the like. When such a substrate is used for the substrate 701, the area and the shape thereof are not particularly restricted. Therefore, when a rectangular substrate with at least one meter on a side is used, productivity can be significantly improved. This is a great advantage compared to the case of using a circular silicon substrate. In the present step, although the release layer 702 is provided over the entire surface of the substrate 701, the release layer 702 may be provided selectively by a photolithography method as needed after the release layer is provided over the entire surface of the substrate 701. In addition, although the release layer 702 is formed to be in contact with the substrate 701, it is also possible to form a base insulating film to be in contact with the substrate 701 and then form the release layer 702 to be in contact with the insulating film.

The release layer 702 may be formed using a metal film or a stacked structure of a metal film and a metal oxide film. As a metal film, a single layer or stacked layers are formed using an element selected from tungsten (W), molybdenum (Mo), titanium (Ti), tantalum (Ta), niobium (Nb), nickel (Ni), cobalt (Co), zirconium (Zr), zinc (Zn), ruthenium (Ru), rhodium (Rh), palladium (Pd), osmium (Os), or iridium (Ir), or an alloy material or a compound material containing such an element as a main component. In addition, such materials can be deposited by a sputtering method, various CVD methods such as a plasma CVD method, or the like. A stacked structure of a metal film and a metal oxide film can be obtained by the steps of forming the above-described metal film and then applying plasma treatment thereto under an oxygen atmosphere or an $N_2O$ atmosphere or applying thermal treatment thereto under an oxygen atmosphere or an $N_2O$ atmosphere, so that oxide or oxynitride of the metal film can be formed on the metal film.

For example, when a tungsten film is provided as a metal film by a sputtering method, a CVD method, or the like, a metal oxide film made of tungsten oxide can be formed on the surface of the tungsten film by applying plasma treatment to the tungsten film. In forming tungsten oxide, there is no particular limitation on the amount of oxygen, and which kind of oxide is to be formed may be determined in accordance with the etching rate or the like.

The base insulating film 703 is formed in a single layer or stacked layers by depositing a film containing silicon oxide or silicon nitride by a sputtering method, a plasma CVD method, or the like. In the case where the base insulating film is formed to have a two-layer structure, for example, a silicon nitride oxide film and a silicon oxynitride film may be formed as a first layer and a second layer, respectively. In the case where the base insulating film is formed to have a three-layer structure, a silicon oxide film, a silicon nitride oxide film, and a silicon oxynitride film may be formed as first to third insulating films, respectively. Alternatively, a silicon oxynitride film, a silicon nitride oxide film, and a silicon oxynitride film may be formed as the first to third insulating films, respectively. The base insulating film functions as a blocking film for preventing intrusion of impurities from the substrate 701.

The amorphous semiconductor film 704 is formed to a thickness of 25 to 200 nm (preferably, 30 to 150 nm) by a sputtering method, an LPCVD method, a plasma CVD method, or the like.

Figure 8B:
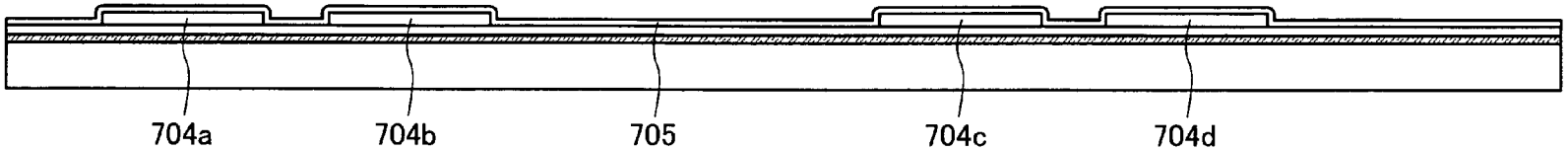

Next, the amorphous semiconductor film 704 is crystallized by a laser crystallization method, a thermal crystallization method using RTA or an annealing furnace, a crystallization method using a metal element that promotes crystallization, or a method combining them, whereby a crystalline semiconductor film is formed. Thereafter, the crystalline semiconductor film obtained is etched into desired shapes, whereby crystalline semiconductor films 704*a* to 704*d* are formed. Then, a gate insulating film 705 is formed so as to cover the semiconductor films 704*a* to 704*d* (see FIG. 8B).

An exemplary fabrication process of the crystalline semiconductor films 704*a* to 704*d* will be briefly described below. First, an amorphous semiconductor film with a thickness of 50 to 60 nm is deposited by a plasma CVD method. Then, a solution containing nickel which is a metal element for promoting crystallization is retained on the amorphous semiconductor film, which is followed by dehydrogenation treatment (500° C. for one hour) and thermal treatment (550° C. for four hours). Thus, a crystalline semiconductor film is formed. Thereafter, the crystalline semiconductor film is irradiated with laser light by a photolithography method and etched as needed, whereby the crystalline semiconductor films 704*a* to 704*d* are formed.

When the crystalline semiconductor films are formed by a laser crystallization method, either continuous wave laser beams (CW laser beams) or pulsed laser beams can be used. Laser beams that can be used here include those emitted from gas lasers such as an Ar laser, a Kr laser, and an excimer laser; a laser in which single-crystalline YAG, $YVO_4$, forsterite ($Mg_2SiO_4$), $YAlO_3$, or $GdVO_4$ or polycrystalline (ceramic) YAG; $Y_2O_3$, $YVO_4$, $YAlO_3$, or $GdVO_4$ is doped with one or more laser media selected from Nd, Yb, Cr, Ti, Ho, Er, Tm, or Ta; a glass laser; a ruby laser; an alexandrite laser; a Ti:sapphire laser; a copper vapor laser; and a metal vapor laser. When irradiation is carried out with the fundamental wave of such laser beams or the second to fourth harmonics of the fundamental wave, crystals with a large grain size can be obtained. For example, the second harmonic (532 nm) or the third harmonic (355 nm) of an Nd:$YVO_4$ laser (a fundamental wave of 1064 nm) can be used. In this case, a laser power density of about 0.01 to 100 MW/cm$^2$ (preferably, 0.1 to 10 MW/cm$^2$) is required, and irradiation is conducted with a scanning rate of about 10 to 2000 cm/sec. Note that the laser in which single-crystalline YAG, $YVO_4$, forsterite ($Mg_2SiO_4$), $YAlO_3$, or $GdVO_4$ or polycrystalline (ceramic) YAG, $Y_2O_3$, $YVO_4$, $YAlO_3$, or $GdVO_4$ is doped with one or more laser media selected from Nd, Yb, Cr, Ti, Ho, Er, Tm, or Ta as dopant; an Ar ion laser, or a Ti:sapphire laser can be used as a CW laser, whereas they can also be used as pulsed laser with a repetition rate of 10 MHz or more by being combined with a Q-switch operation or mode locking. When a laser beam with a repetition rate of 10 MHz or more is used, it is possible for a semiconductor film to be irradiated with the next pulse after it is melted by the previous laser and before it becomes solidified. Therefore, unlike the case of using a pulsed laser with a low repetition rate, a solid-liquid interface in the semiconductor film can be continuously moved. Thus, crystal grains that have grown continuously in the scanning direction can be obtained. By arranging transistors so that channel length directions thereof (a direction in which carriers move when channel formation regions are formed) are aligned with the scanning direction, and combining the semiconductor films with a gate insulating layer, thin film transistors (TFTs) that has few variations in characteristics and high electron field-effect mobility can be obtained.

In addition, when the amorphous semiconductor film is crystallized by using a metal element that promotes crystallization, there are advantages in that crystallization can be conducted at a low temperature in a short time and the direction of crystals can be uniform, whereas there are also disadvantages in that the metal element remains in the crystalline semiconductor films, which could result in increased off-current and unstable characteristics. Therefore, it is preferable to form an amorphous semiconductor film functioning as a gettering site over the crystalline semiconductor films. The amorphous semiconductor film to function as a gettering site should contain an impurity element such as phosphorus or argon. Therefore, such an amorphous semiconductor film is preferably formed by a sputtering method by which the semiconductor film can contain a high concentration of argon. Thereafter, thermal treatment (e.g., thermal annealing using an RTA method or an annealing furnace) is applied, so that the metal element is diffused into the amorphous semiconductor film, and then the amorphous semiconductor film containing the metal element is removed. Accordingly, the metal element contained in the crystalline semiconductor films can be reduced or removed.

Next, the gate insulating film 705 which covers the crystalline semiconductor films 704*a* to 704*d* is formed. The gate insulating film 705 is formed in a single layer or stacked layers by depositing a film containing silicon oxide or silicon nitride by a CVD method, a sputtering method, or the like. Specifically, the gate insulating film 705 is formed in a single layer or stacked layers by depositing a film containing silicon oxide, a film containing silicon oxynitride, and/or a film containing silicon nitride oxide.

The gate insulating film 705 may also be formed by oxidizing or nitriding the surfaces of the semiconductor films 704*a* to 704*d* by high-density-plasma treatment. For example, plasma treatment with a mixed gas of a rare gas such as He, Ar, Kr, or Xe, and oxygen, nitrogen oxide ($NO_2$), ammonia, nitrogen, or hydrogen is used. When plasma is excited by the introduction of microwaves, plasma with a low electron temperature and a high electron density can be generated. With oxygen radicals (which may also include OH radicals) or nitrogen radicals (which may also include NH radicals) that are produced by the high-density plasma, the surfaces of the semiconductor films can be oxidized or nitrided.

By such high-density-plasma treatment, an insulating film with a thickness of 1 to 20 nm, typically 5 to 10 nm, is formed on the semiconductor films. Since the reaction in this case is a solid-phase reaction, interface state density between the insulating film and the semiconductor films can be made quite low. Also, since such high-density-plasma treatment directly oxidizes (or nitrides) semiconductor films (crystalline silicon or polycrystalline silicon), the insulating film to be formed can have a uniform thickness, which is ideal. Further, since crystal grain boundaries of crystalline silicon are not strongly oxidized, an excellent state can be obtained. That is, by the solid-phase oxidation of the surfaces of the semiconductor films through the high-density-plasma treatment shown in this embodiment mode, an insulating film with a uniform thickness and low interface state density can be formed without excessive oxidation at the crystal grain boundaries.

As the gate insulating film, only an insulating film formed by high-density-plasma treatment may be used, or it is also possible to use stacked layers that are obtained by depositing another insulating film such as silicon oxide, silicon oxynitride, or silicon nitride on the above-mentioned insulating film by a CVD method using plasma or thermal reaction. In any case, a transistor which has an insulating film formed by high-density-plasma treatment in a part or the whole of its gate insulating film can have small variations in characteristics.

Next, a first conductive film and a second conductive film are stacked over the gate insulating film 705. Here, the first conductive film is formed to a thickness of 20 to 100 nm by a plasma CVD method, a sputtering method, or the like. The second conductive film is formed to a thickness of 100 to 400 nm. The first conductive film and the second conductive film are formed with an element selected from tantalum (Ta), tungsten (W), titanium (Ti), molybdenum (Mo), aluminum (Al), copper (Cu), chromium (Cr), niobium (Nb), or the like, or an alloy material or a compound material containing such an element as a main component. Alternatively, the first conductive film and the second conductive are formed with a semiconductor material typified by polycrystalline silicon doped with an impurity element such as phosphorus. As a combination example of the first conductive film and the second conductive film, a tantalum nitride film and a tungsten film; a tungsten nitride film and a tungsten film; a molybdenum nitride film and a molybdenum film; and the like can be given. Tungsten and tantalum nitride have high heat resistance. Therefore, after forming the first conductive film and the second conductive film using tungsten and tantalum nitride, thermal treatment can be applied thereto for the purpose of thermal activation. In addition, in the case where a two-layer structure is not employed, but a three-layer structure is employed, it is preferable to form a stacked structure of a molybdenum film, an aluminum film, and a molybdenum film.

Next, a resist mask is formed by a photolithography method, and etching treatment for forming gate electrodes and gate lines is applied. Thus, gate electrodes 707 are formed above the semiconductor films 704*a* to 704*d*.

Next, the crystalline semiconductor films 704*a* to 704*d* are doped with an impurity element which imparts n-type conductivity by an ion doping method or an ion implantation method, using the gate electrodes 707 as masks, so that the crystalline semiconductor films 704*a* to 704*d* contain the impurity element at a low concentration. As the impurity element which imparts n-type conductivity, a Group 15 element such as phosphorus (P) or arsenic (As) may be used.

Next, an insulating film is formed so as to cover the gate insulating film 705 and the gate electrodes 707. The insulating film is formed in a single layer or stacked layers by depositing a film containing an inorganic material such as silicon, silicon oxide, or silicon nitride, or a film containing an organic material such as an organic resin by a plasma CVD method, a sputtering method, or the like. Next, the insulating film is selectively etched by anisotropic etching (mainly in the perpendicular direction), whereby insulating films 708 (also called sidewalls) that are in contact with the side surfaces of the gate electrodes 707 are formed. The insulating films 708 are used as doping masks for forming LDD (Lightly Doped Drain) regions in a subsequent step.

Figure 8C:
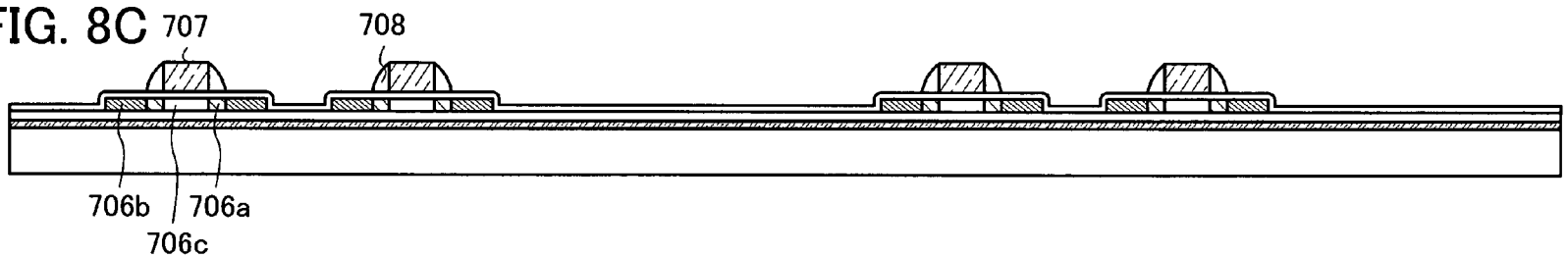

Next, the crystalline semiconductor films 704*a* to 704*d* are doped with an impurity element which imparts n-type conductivity, using the gate electrodes 707 and the insulating films 708 as masks, whereby first n-type impurity regions 706 (also called LDD regions), second n-type impurity regions 706*b*, and a channel region 706*c* are formed (see FIG. 8C). The concentration of the impurity element contained in the first n-type impurity region 706*a* is lower than the concentration of the impurity element contained in the second n-type impurity region 706*b*.

Figure 8D:
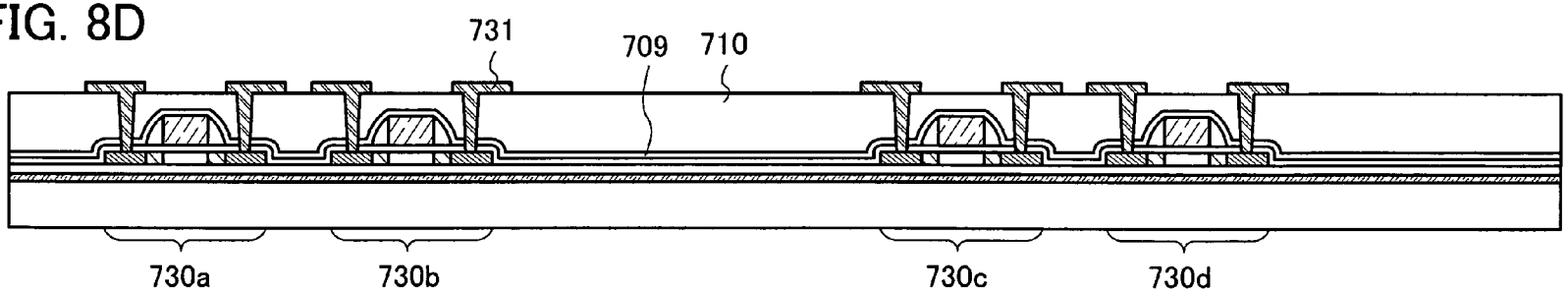

Next, an insulating film is formed in a single layer or stacked layers so as to cover the gate electrodes 707, the insulating films 708, and the like, whereby thin film transistors 730*a* to 730*d* are formed (FIG. 8D). The insulating film is formed in a single layer or stacked layers by depositing an inorganic material such as silicon oxide or silicon nitride, an organic material such as polyimide, polyamide, benzocyclobutene, acrylic, or epoxy, a siloxane material, or the like by a CVD method, a sputtering method, a SOG method, a droplet discharge method, a screen printing method, or the like. For example, when the insulating film is formed to have a two-layer structure, a silicon nitride oxide film and a silicon oxynitride film can be formed as a first insulating film 709 and a second insulating film 710, respectively.

Note that before the insulating films 709 and 710 are formed or after one or both of them is/are formed, thermal treatment is preferably applied for recovery of the crystallinity of the semiconductor films, activation of the impurity element that has been added into the semiconductor films, or hydrogenation of the semiconductor films. As the thermal treatment, thermal annealing, laser annealing, RTA, or the like is preferably applied.

Next, the insulating films 709 and 710 are patterned by a photolithography method and etching, whereby contact holes that expose the second n-type impurity regions 706*b* are formed. Then, a conductive film is formed so as to fill the contact holes and the conductive film is selectively etched to form conductive films 731. Note that before the formation of the conductive films, silicide may be formed on the surfaces of the semiconductor films 704*a* to 704*d* that are exposed at the contact holes.

The conductive films 731 are formed in a single layer or stacked layers, using an element selected from aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), or silicon (Si), or an alloy material or a compound material containing such an element as a main component. An alloy material containing aluminum as a main component corresponds to, for example, a material which contains aluminum as a main component and also contains nickel, or a material which contains aluminum as a main component and also contains nickel and one or both of carbon and silicon. The conductive films 731 are preferably formed to have a stacked structure of a barrier film, an aluminum-silicon (Al—Si) film, and a barrier film. Note that "barrier film" corresponds to a thin film made of titanium, titanium nitride, molybdenum, or molybdenum nitride. Aluminum and aluminum silicon, which have low resistance values and are inexpensive, are the most suitable material for forming the conductive films 731. When barrier layers are provided as the top layer and the bottom layer, generation of hillocks of aluminum or aluminum silicon can be prevented. In addition, when a barrier film made of titanium which is an element having a high reducing property is formed, even when there is a thin natural oxide film formed on the crystalline semiconductor film, the natural oxide film can be reduced, and a favorable contact between the conductive film 731 and the crystalline semiconductor film can be obtained.

Figures 9A, 9B, 9C:
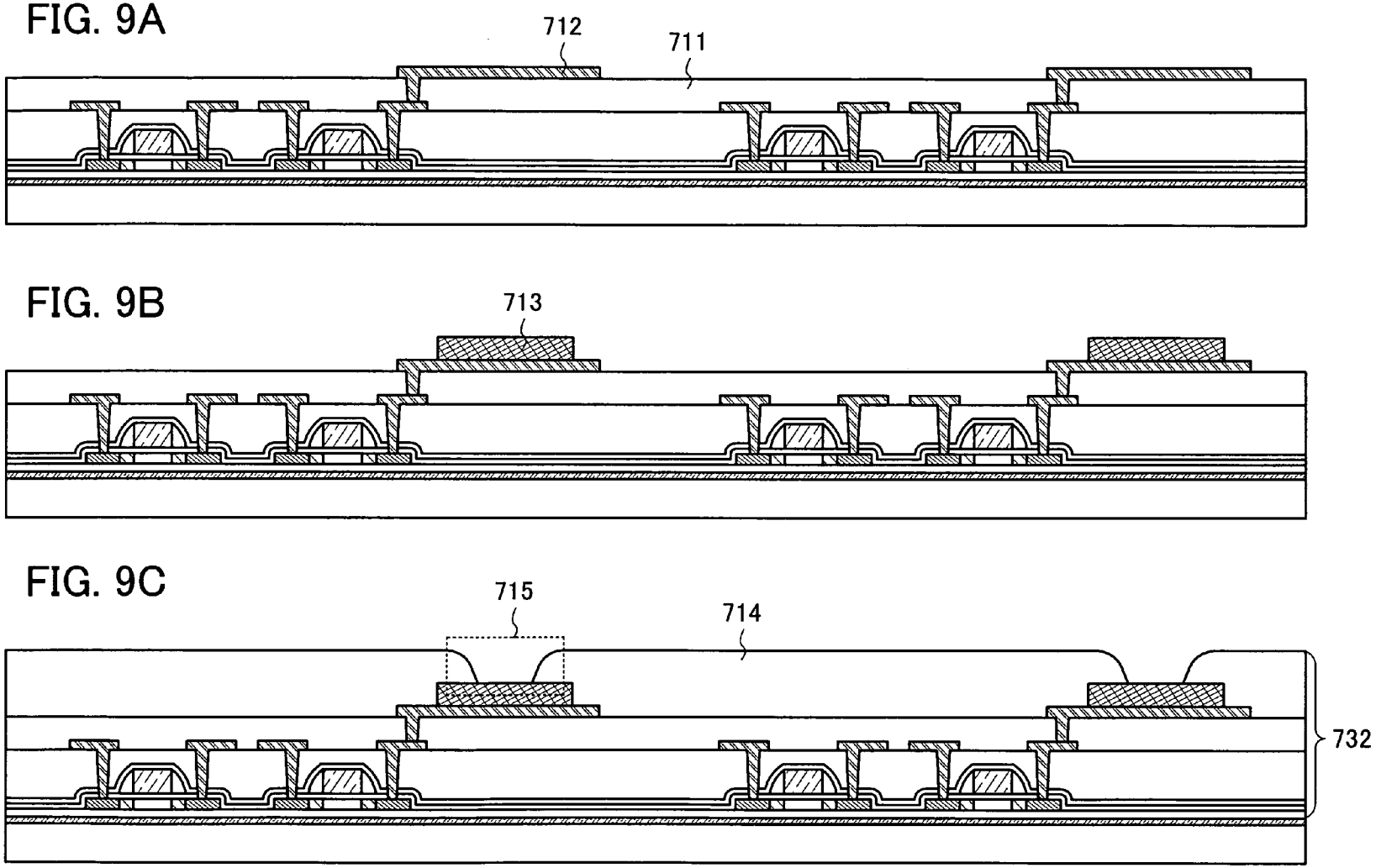
FIGS. 9A to 9C illustrate a method of fabricating the semiconductor device of the invention.

Next, an insulating film 711 is formed so as to cover the conductive films 731, and conductive films 712 are formed over the insulating film 711 so as to be electrically connected to the conductive films 731 (FIG. 9A). The insulating film 711 is formed in a single layer or stacked layers by depositing an inorganic material or an organic material by a CVD method, a sputtering method, a SOG method, a droplet discharge method, a screen printing method, or the like. Preferably, the insulating film 711 is formed to a thickness of 0.75 to 3 μm. In addition, the conductive films 712 can be formed by using any of the above-described materials used for the conductive films 731.

Next, conductive films 713 are formed over the conductive films 712. The conductive films 713 are formed by depositing a conductive material by a CVD method, a sputtering method, a droplet discharge method, a screen printing method, or the like (FIG. 9B). Preferably, the conductive films 713 are formed in a single layer or stacked layers, using an element selected from aluminum (Al), titanium (Ti), silver (Ag), copper (Cu), or gold (Au), or an alloy material or a compound material containing such an element as a main component. Here, the conductive films 713 are formed by depositing paste containing silver over the conductive films 712 by a screen printing method, and applying thermal treatment thereto at 50 to 350° C. Further, after the formation of the conductive films 713 over the conductive films 712, a region where the conductive films 713 and 712 overlap one another may be irradiated with laser light in order to improve electrical connection therebetween. Note that it is also possible to selectively provide the conductive films 713 over the conductive films 731 without providing the insulating film 711 and the conductive films 712.

Next, an insulating film 714 is formed so as to cover the conductive films 712 and 713, and the insulating film 714 is patterned by a photolithography method and etching, whereby openings 715 that expose the conductive films 713 are formed (FIG. 9C). The insulating film 714 is formed in a single layer or stacked layers by depositing an inorganic material or an organic material by a CVD method, a sputtering method, a SOG method, a droplet discharge method, a screen printing method, or the like.

Figure 10A:
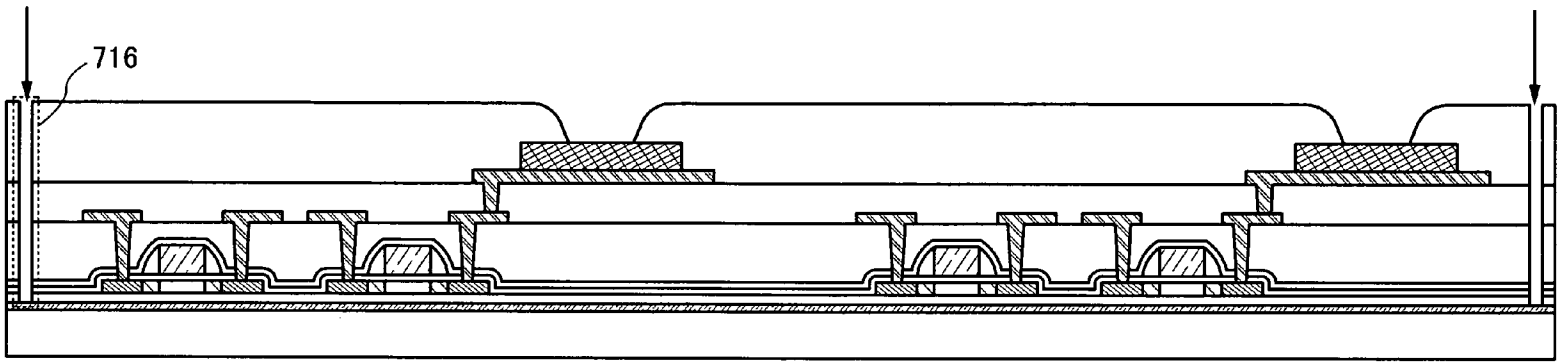
FIGS. 10A and 10B illustrate a method of fabricating the semiconductor device of the invention.

Next, a layer 732 including the thin film transistors 730*a* to 730*d* and the like (hereinafter also simply referred to as a "layer 732") is peeled off the substrate 701. Here, openings 716 are formed by laser (e.g., UV) irradiation (FIG. 10A), and then the layer 732 can be peeled off the substrate 701 with physical force. In addition, before the layer 732 is peeled off the substrate 701, an etchant may be introduced into the openings 716 to remove the release layer 702. As an etchant, gas or liquid containing halogen fluoride or an interhalogen compound is used. For example, when chlorine trifluoride ($ClF_3$) is used as a gas containing halogen fluoride, the layer 732 is peeled off the substrate 701. Note that the release layer 702 may be partially left without being completely removed. Accordingly, consumption of etchant can be suppressed, and time required for removing the release layer can be reduced. Further, the layer 732 may be retained above the substrate 701 even after removal of the release layer 702. The substrate 701 from which the layer 732 is peeled is preferably reused for cost saving.

Figure 10B:
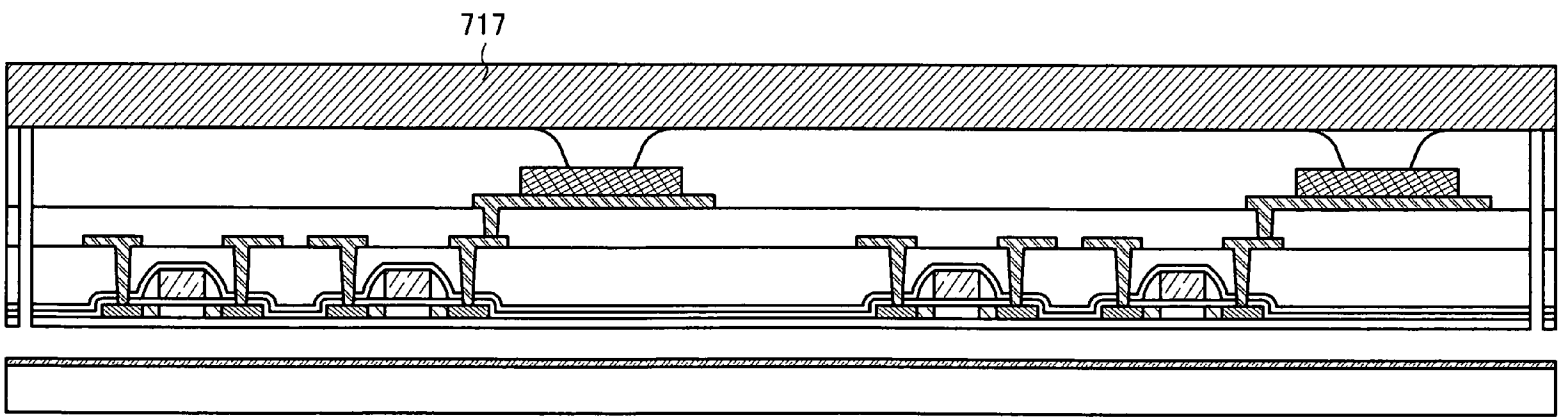

Here, after forming the openings 716 by etching the insulating film through laser irradiation, a first sheet material 717 is attached to one surface of the layer 732 (the surface where the insulating film 714 is exposed), and then the layer 732 is completely peeled off the substrate 701 (see FIG. 10B). For the first sheet material 717, for example, a heat peelable tape whose adhesive strength becomes weak by application of heat can be used.

Figure 11A:
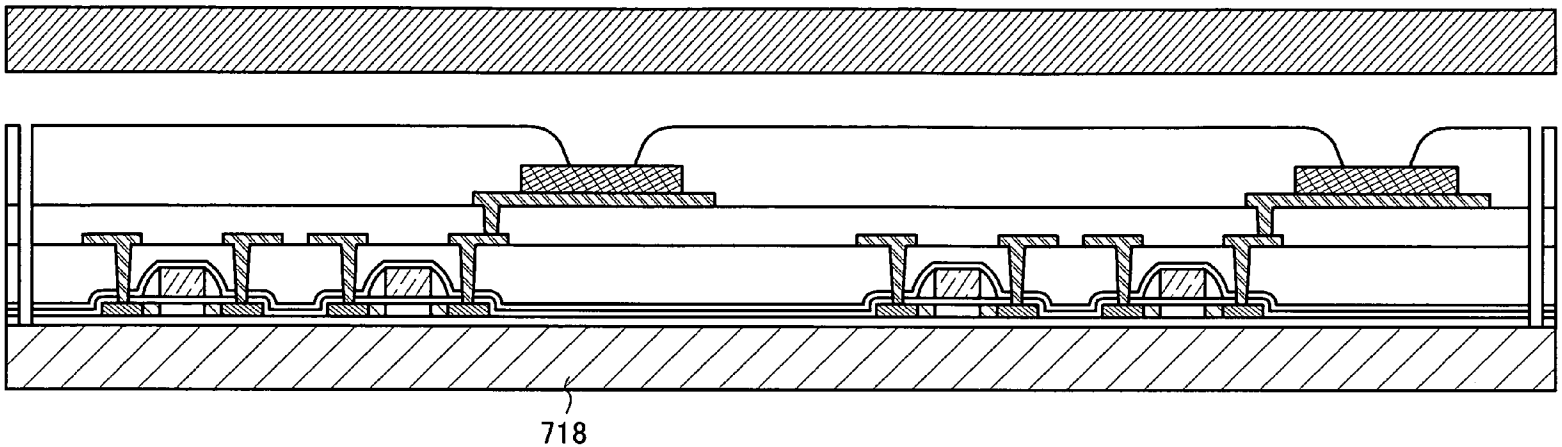
FIGS. 11A and 11B illustrate a method of fabricating the semiconductor device of the invention.

Next, a second sheet material 718 is attached to the other surface of the layer 732 (the surface exposed by peeling), followed by one or both of thermal treatment and pressurization treatment so that the second sheet material 718 is tightly fixed. At the same time as or after the second sheet material 718 is provided, the first sheet material 717 is peeled (FIG. 11A). For the second sheet material 718, a hot-melt film or the like can be used. In addition, when a heat peelable tape is used for the first sheet material 717, it may be peeled by utilizing heat applied in attaching the second sheet material 718.

As the second sheet material 718, a film on which antistatic treatment for preventing static electricity or the like has been applied (hereinafter referred to as an antistatic film) can also be used. Examples of the antistatic film include a film in which an antistatic material is dispersed in a resin, a film to which an antistatic material is attached, and the like. The film provided with an antistatic material can be a film with an antistatic material provided over one of its surfaces, or a film with an antistatic material provided over each of its surfaces. Concerning the film with an antistatic material provided over one of its surfaces, the film may be attached to the layer 732 so that the antistatic material is placed on the inner side of the film or the outer side of the film. The antistatic material may be provided over the entire surface of the film, or over a part of the film. As an antistatic material, a metal, indium tin oxide (ITO), or a surfactant such as an amphoteric surfactant, a cationic surfactant, or a nonionic surfactant can be used. In addition, as an antistatic material, a resin material which contains a cross-linked copolymer having a carboxyl group and a quaternary ammonium base on its side chain, or the like can be used. By attaching, mixing, or applying such a material to a film, an antistatic film can be formed. By sealing the layer 732 using the antistatic film, the semiconductor elements can be prevented from adverse effects such as external static electricity when dealt with as a commercial product.

Figure 11B:
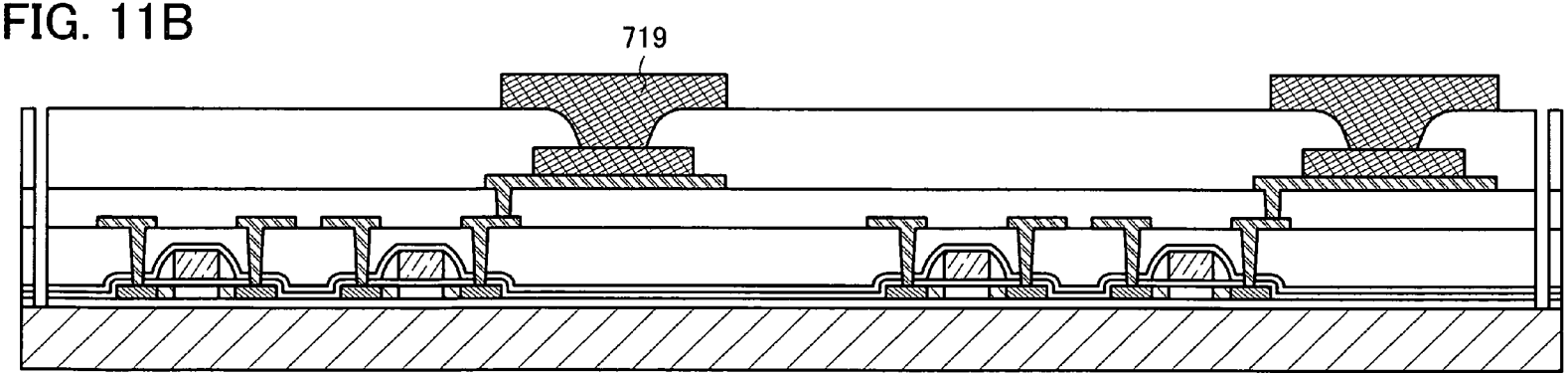

Next, conductive films 719 are formed so as to cover the openings 715 (FIG. 11B). Note that before or after the formation of the conductive films 719, the conductive films 712 and 713 may be irradiated with laser light to improve electrical connection.

Figure 12A:
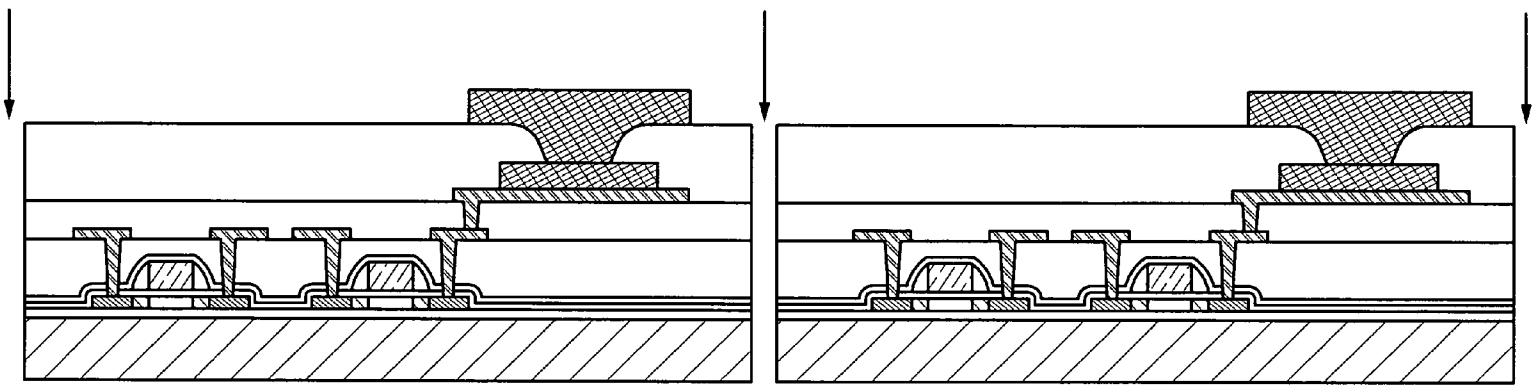
FIGS. 12A and 12B illustrate a method of fabricating the semiconductor device of the invention.

Next, the layer 732 is cut into a plurality of element layers by selective laser irradiation (FIG. 12A).

Through the above-described steps, the element layers can be fabricated.

Figure 12B:
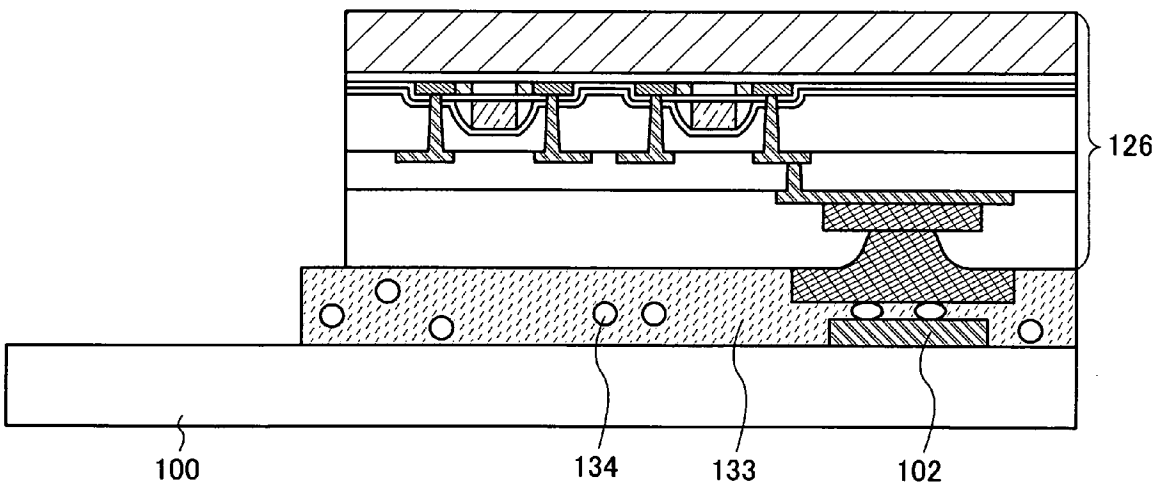

Next, an element layer 126 obtained by cutting is pressure-bonded to the substrate 100 having the conductor patterns 101 to 103 functioning as an antenna (FIG. 12B). Specifically, as mentioned in the preceding embodiment mode, attachment is carried out such that the conductor pattern 102 formed on the substrate 100 and functioning as the antenna is electrically connected to the conductive film 719 of the element layer 126. Here, the element layer 126 is attached to the substrate 100 with an adhesive resin 133. In addition, the conductive film 719 and the conductor pattern 102 are electrically connected with conductive particles 134 contained in the resin 133.

This embodiment can be applied to the fabrication of the semiconductor devices shown in other embodiment modes.

Embodiment Mode 5

This embodiment mode will describe an antenna or a semiconductor device which differs from those shown in the foregoing embodiment modes, with reference to the drawings.

Figure 4:
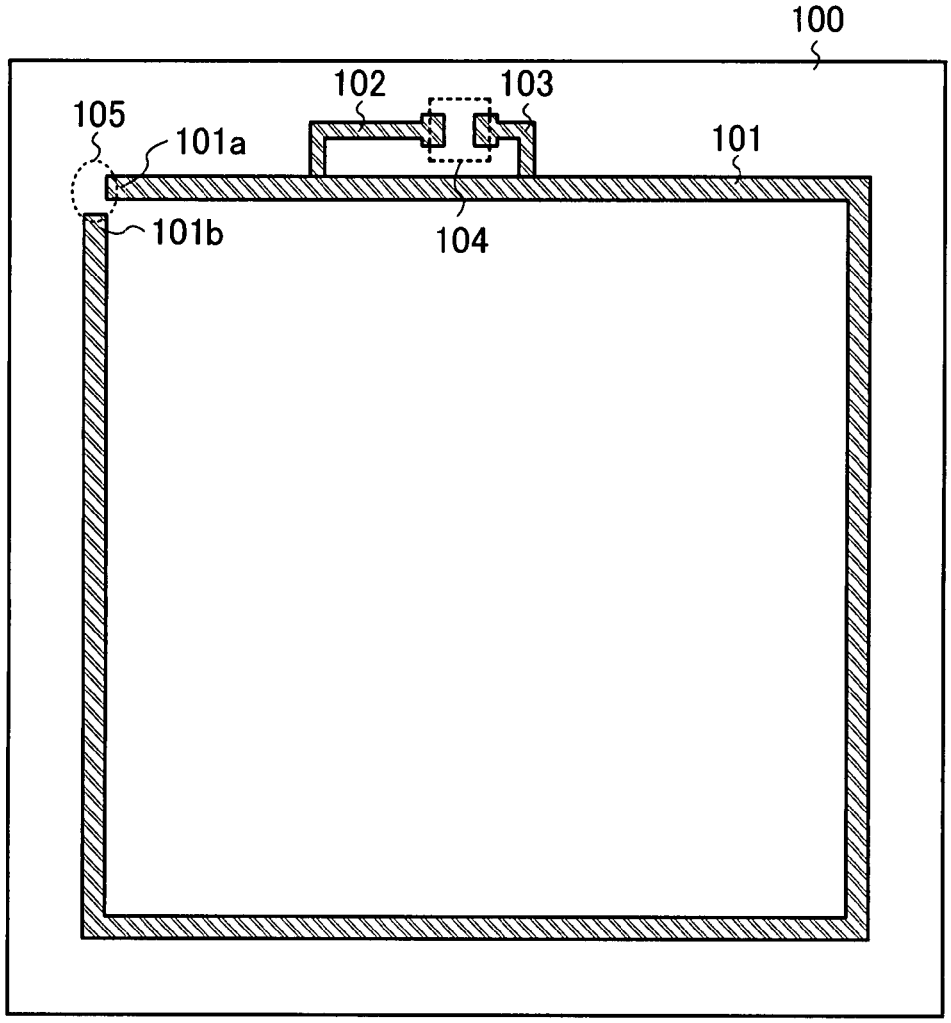
FIG. 4 illustrates an exemplary antenna of the invention.

A semiconductor device shown in this embodiment mode has a configuration in which a feeding section provided with an element layer and the like is disposed outside a conductor pattern with a loop configuration (see FIG. 4). This configuration is particularly effective in the case where an element layer is large and is difficult to be disposed inside the conductor pattern with the loop configuration. Note that the conductor patterns 102 and 103 and the feeding section 104 disposed outside the conductor pattern 101, and the conductor patterns 102 and 103 and the feeding section 104 when they are disposed inside the conductor pattern 101 may respectively be symmetrical to the conductor pattern 101.

In addition, when the feeding section 104 is disposed outside the conductor pattern 101 as shown in FIG. 4, the inner side of the conductor pattern 101 can be used for a different purpose. For example, suppose a case that the antenna of the invention is used as an RFID tag, and the RFID tag is attached to a recording medium such as a CD-ROM or a DVD-ROM in such a manner that the RFID tag is placed in the central hole portion of the recording medium. In that case, the RFID tag also needs to have a circular hole in the center. Thus, the antenna with the shape shown in this embodiment mode is suitable for such use.

Embodiment Mode 6

Figure 13A:
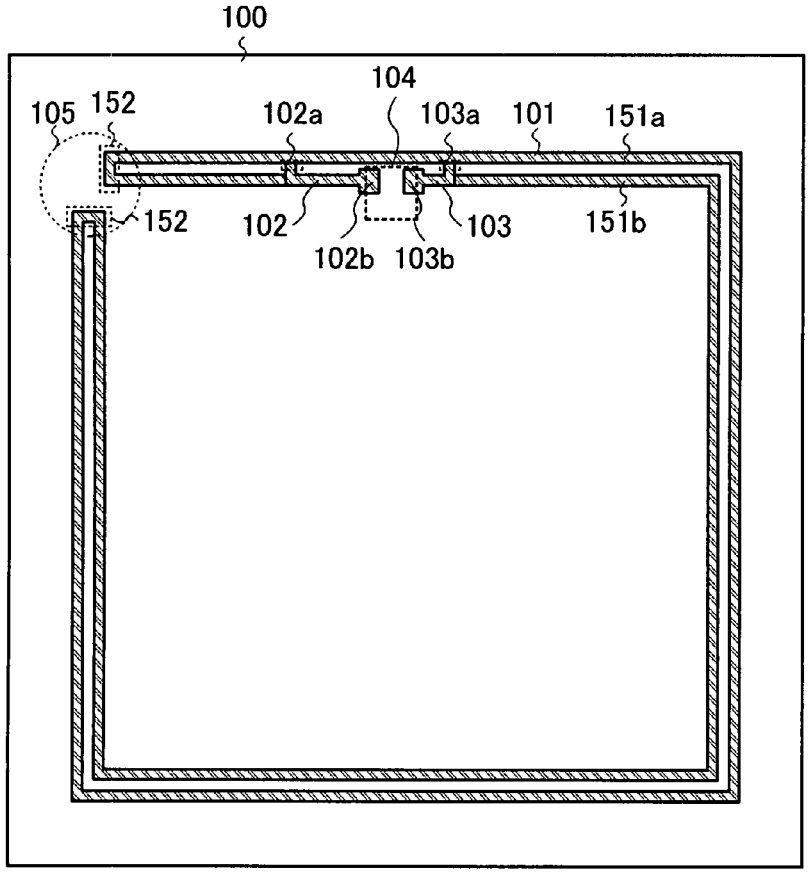
FIGS. 13A and 13B illustrate an exemplary antenna of the invention.
Figure 13B:
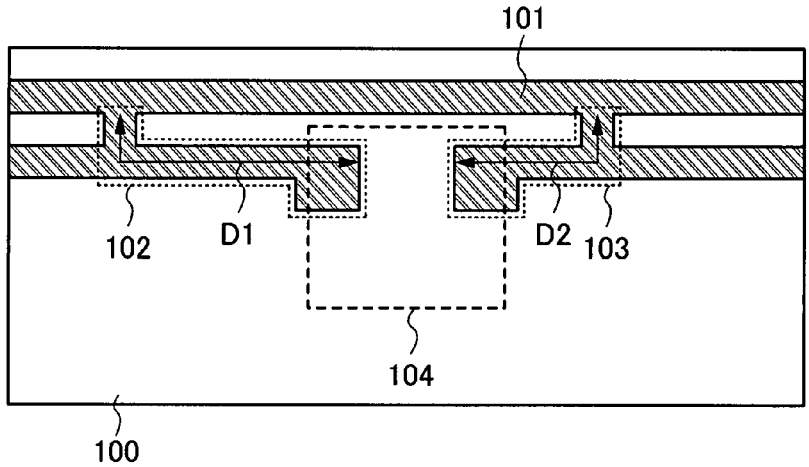

This embodiment mode will describe an antenna or a semiconductor device which differs from those shown in the foregoing embodiment modes, with reference to FIGS. 13A and 13B.

An antenna shown in this embodiment mode has a configuration in which the conductor pattern 101 of the antenna shown in FIG. 1A has two conductors that are disposed in parallel. Here, an example is shown in which the conductor pattern 101 has an outer side 151*a* and an inner side 151*b* that are disposed with a constant distance therebetween and are connected by a conductor 152.

In this case, the feeding section 104 is connected to the second end portion 102*b* of the second conductor pattern 102 and the second end portion 103*b* of the third conductor pattern 103. In addition, the first end portion 102*a* of the second conductor pattern 102 and the first end portion 103*a* of the third conductor pattern 103 are connected to the outer side 151*a* of the conductor pattern 101, and end portions of the inner side 151*b* of the conductor pattern 101 are connected to the second conductor pattern 102 and the third conductor pattern 103. With the conductor pattern 101 provided like FIGS. 13A and 13B, the radiant efficiency of the antenna can be improved. Note that although FIGS. 13A and 13B show the case where the conductor 152 is provided only at a portion facing the cut section 105, the number and position of the conductor 152 are not limited thereto.

Embodiment Mode 7

This embodiment mode will describe a configuration of an RFID tag for which a semiconductor device with the antenna shown in the foregoing embodiment mode is used, with reference to the drawings.

Figure 14:
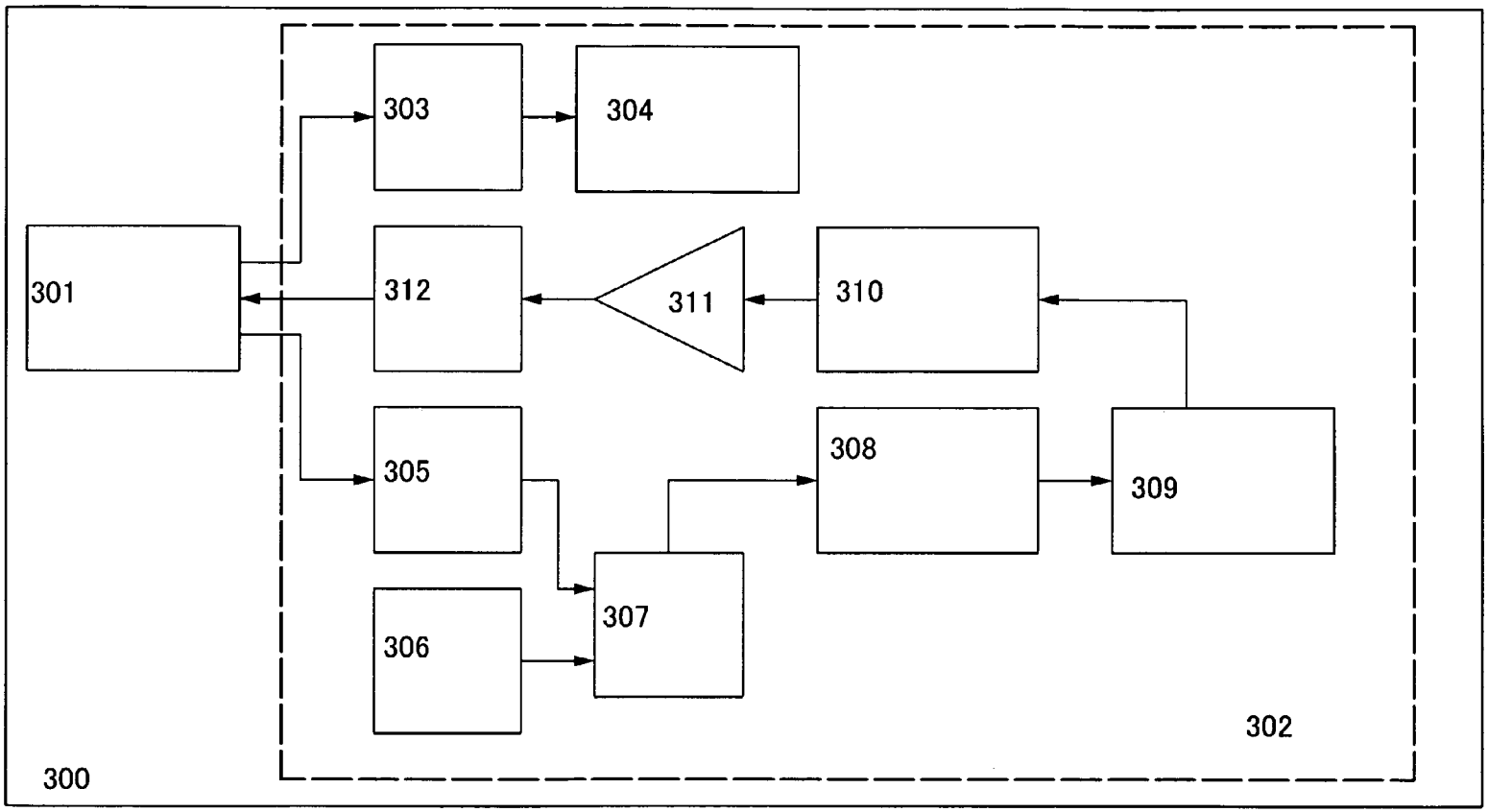
FIG. 14 illustrates a configuration of the semiconductor device of the invention.

A block diagram of the RFID of this embodiment mode is shown in FIG. 14.

An RFID tag 300 in FIG. 14 has an antenna circuit 301 and a signal processing circuit 302. The signal processing circuit 302 includes a rectifier circuit 303, a power supply circuit 304, a demodulation circuit 305, an oscillation circuit 306, a logic circuit 307, a memory control circuit 308, a memory circuit 309, a logic circuit 310, an amplifier 311, and a modulation circuit 312.

Communication signals received by the antenna circuit 301 of the RFID tag 300 are input into the demodulation circuit 305 of the signal processing circuit 302. The frequency of the communication signals received, that is, signals communicated between the antenna circuit 301 and a reader/writer can be, for example, UHF (ultra high frequency) bands including 915 MHz, 2.45 GHz, and the like that are determined based on the ISO standards or the like. Needless to say, the frequency of signals communicated between the antenna circuit 301 and the reader/writer is not limited to these, and for example, any of the following frequencies can be used: submillimeter waves of 300 GHz to 3 THz, millimeter waves of 30 GHz to 300 GHz, microwaves of 3 GHz to 30 GHz, a ultra high frequency of 300 MHz to 3 GHz, and a very high frequency of 30 MHz to 300 MHz. In addition, signals communicated between the antenna circuit 301 and the reader/writer are signals obtained through carrier modulation. A carrier modulation method can be either analog modulation or digital modulation, and any of amplitude modulation, phase-modulation, frequency modulation, and spread spectrum can be used. Preferably, amplitude modulation or frequency modulation is used.

An oscillation signal output from the oscillation circuit 306 is supplied as a clock signal to the logic circuit 307. In addition, carriers that have been modulated are demodulated in the demodulation circuit 305, and the demodulated signal is transmitted to and analyzed in the logic circuit 307. The signal analyzed in the logic circuit 307 is transmitted to the memory control circuit 308. Based on the analyzed signal, the memory control circuit 308 controls the memory circuit 309, extracts data stored in the memory circuit 309, and transmits the data to the logic circuit 310. The signal transmitted to the logic circuit 310 is encoded in the logic circuit 310 and amplified in the amplifier 311. With the amplified signal, the modulation circuit 312 modulates carriers. With the modulated carriers, the reader/writer recognizes the signal from the RFID tag. On the other hand, carriers input to the rectifier circuit 303 are rectified and input to the power supply circuit 304. A power supply voltage obtained in this manner is supplied by the power supply circuit 304 to the demodulation circuit 305, the oscillation circuit 306, the logic circuit 307, the memory control circuit 308, the memory circuit 309, the logic circuit 310, the amplifier 311, the modulation circuit 312, and the like. Note that the power supply circuit 304 is not necessary provided. In FIG. 14, the power supply circuit 304 has a function of stepping down or stepping up an input voltage or inverting the polarity of the input voltage. The RFID tag 300 operates in this manner.

The shape of an antenna included in the antenna circuit 301 may be selected from those described in the foregoing embodiment modes. In addition, a connection method of the signal processing circuit and the antenna circuit is not specifically limited. For example, the antenna and the signal processing circuit may be connected by wire bonding or bump connection. Alternatively, the signal processing circuit may be formed in a chip and one surface thereof may be used as an electrode to be attached to the antenna. In addition, the signal processing circuit and the antenna can be attached to each other by use of an ACF (anisotropic conductive film).

Note that the antenna may be either stacked over the same substrate as the signal processing circuit 302, or formed as an external antenna. Needless to say, the antenna may also be provided on the top or bottom of the signal processing circuit.

The rectifier circuit 303 may be any circuit as long as it converts AC signals that are induced by carriers received by the antenna circuit 301 into DC signals.

Although the value of a power supply voltage obtained by an RFID tag easily changes depending on the reception state of circularly polarized waves transmitted from a reader/writer, the use of the antenna of the invention allows the RFID tag to effectively receive circularly polarized waves transmitted form the reader/writer.

Figure 15:
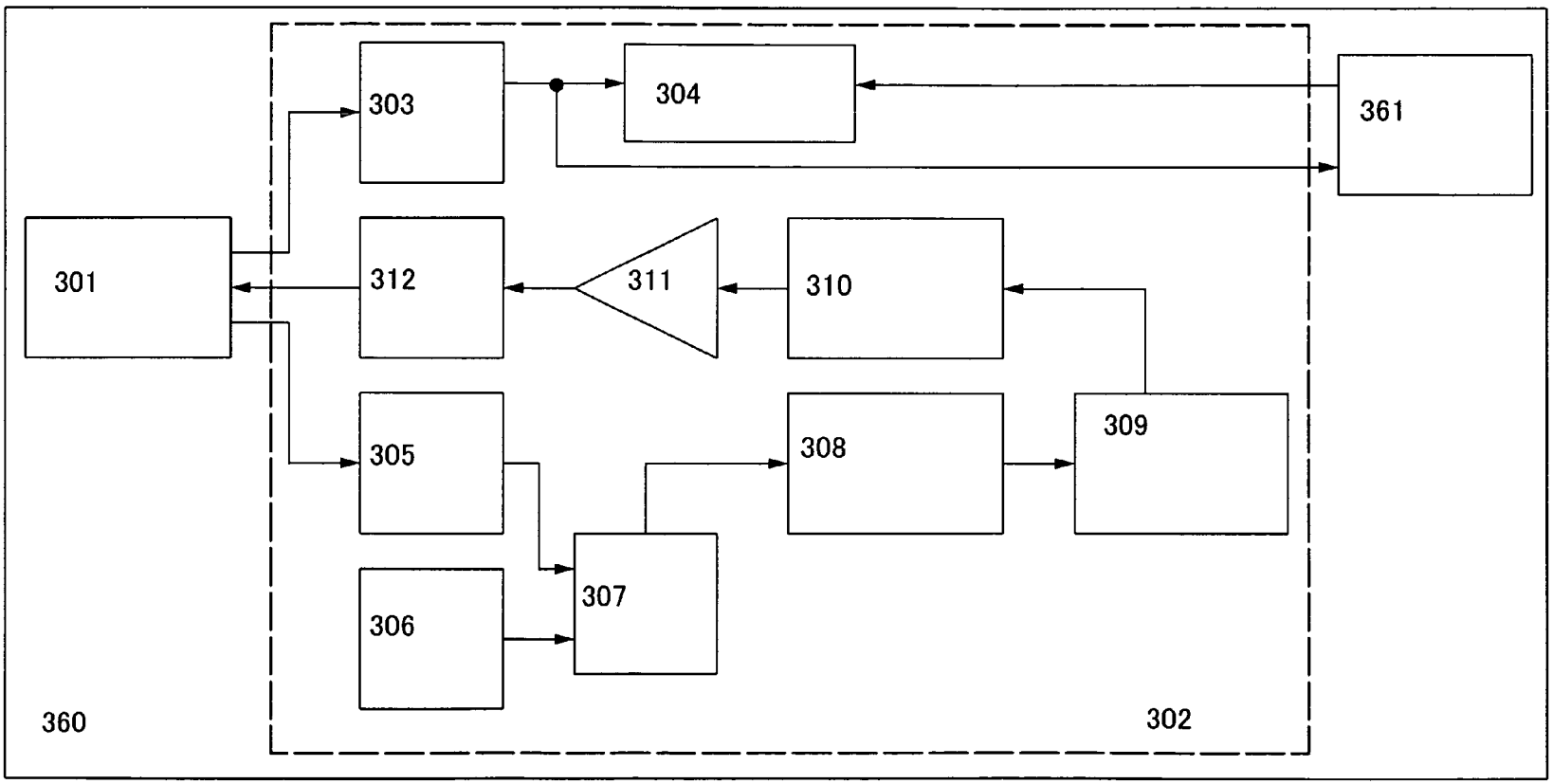
FIG. 15 illustrates a configuration of the semiconductor device of the invention.

Note that the RFID tag shown in this embodiment mode may be provided with a battery 361 as shown in FIG. 15, in addition to the configuration shown in FIG. 14. When a power supply voltage output from the rectifier circuit 303 is not high enough to operate the signal processing circuit 302, the battery 361 may also supply a power supply voltage to each circuit of the signal processing circuit 302, such as the demodulation circuit 305, the oscillation circuit 306, the logic circuit 307, the memory control circuit 308, the memory circuit 309, the logic circuit 310, the amplifier 311, and the modulation circuit 312. Concerning energy to be stored in the battery 361, when the power supply voltage output from the rectifier circuit 303 is sufficiently higher than the power supply voltage required to operate the signal processing circuit 302, for example, a surplus voltage of the power supply voltage output from the rectifier circuit 303 may be stored in the battery 361. It is also possible to provide another set of an antenna circuit and a rectifier circuit in the RFID tag, in addition to the antenna circuit 301 and the rectifier circuit 303 so that the battery 361 can be charged with energy obtained from electromagnetic waves and the like that are generated randomly.

Note that "battery" means a battery whose continuous operating time can be restored by charging. Further, as a battery, a battery formed in a sheet-like form is preferably used. For example, by using a lithium polymer battery that uses a gel electrolyte, a lithium ion battery, a lithium secondary battery, or the like, miniaturization is possible. Needless to say, any battery may be used, as long as it is chargeable. For example, a nickel metal hydride battery, a nickel cadmium battery, a high-capacity capacitor, or the like may be used.

This embodiment mode can apply the configurations of the antennas and the semiconductor devices shown in other embodiment modes.

Embodiment Mode 8

This embodiment mode will describe examples of the application of the semiconductor device of the invention. The semiconductor device of the invention can be used for various applications, and can be applied to any product whose information such as history can be wirelessly obtained by the semiconductor device so that the information can be effectively utilized for production, management, and the like of the product. For example, the semiconductor device of the invention can be applied to bills, coins, securities, documents, bearer bonds, packaging containers, books, storage media, personal belongings, means of transportation, foods, clothes, healthcare items, daily commodities, medicines, electronic devices, and the like. Examples of such application will be described with reference to FIGS. 16A to 16H.

Figure 16A:
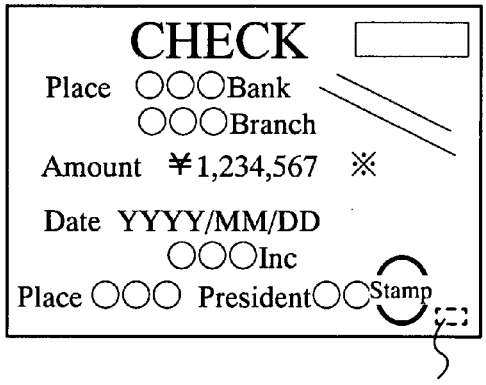
FIGS. 16A to 16H illustrate examples of the use application of the semiconductor device of the invention.
Figure 16B:
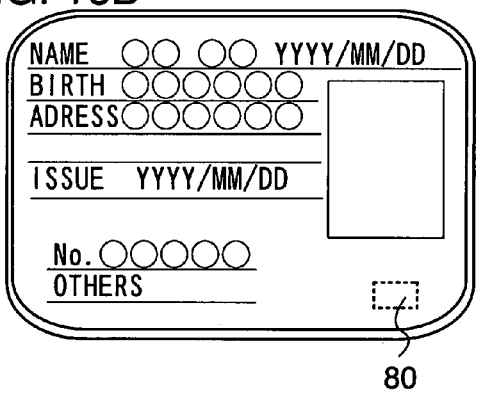
Figure 16C:
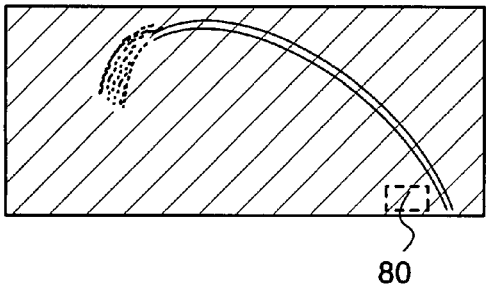
Figure 16D:
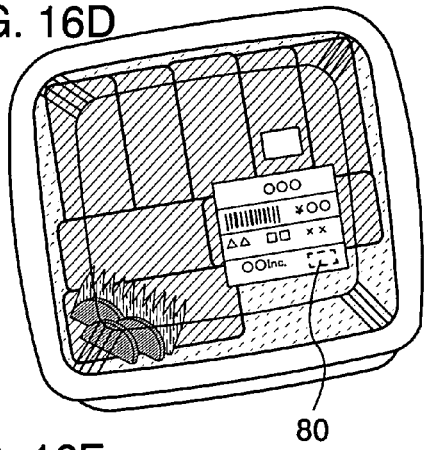
Figure 16E:
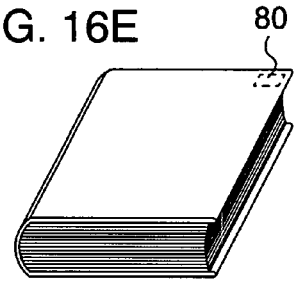
Figure 16F:
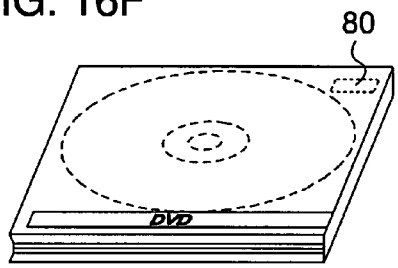
Figure 16G:
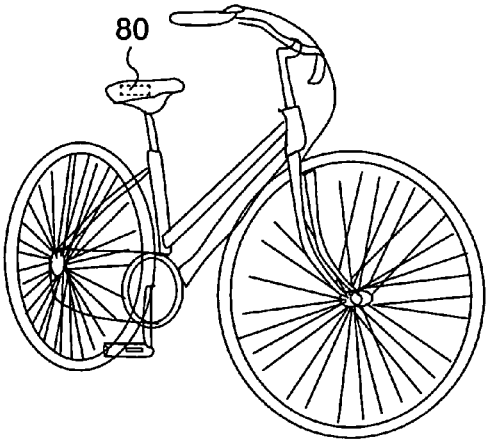
Figure 16H:
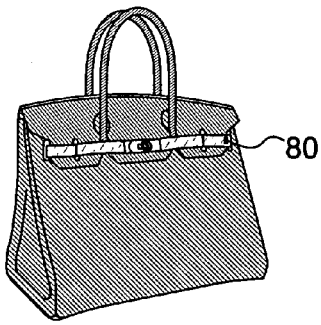

The bills and coins are currency in the market and include notes that are circulating as the real money in specific areas (cash vouchers), memorial coins, and the like. The securities include checks, certificates, promissory notes, and the like (FIG. 16A). The documents include driver's licenses, resident's cards, and the like (FIG. 16B). The bearer bonds include stamps, rice coupons, various gift coupons, and the like (FIG. 16C). The packaging containers include paper for wrapping a lunch box or the like, plastic bottles, and the like (FIG. 16D). The books include documents and the like (FIG. 16E). The storage media include DVD software, video tapes, and the like (FIG. 16F). The means of transportation include wheeled cycles or vehicles such as bicycles, vessels, and the like (FIG. 16G). The personal belongings include shoes, glasses, and the like (FIG. 16H). The foods include food items, beverages, and the like. The clothes include clothing, footwear, and the like. The healthcare items include medical devices, health appliances, and the like. The daily commodities include furniture, lighting apparatuses, and the like. The medicines include medicament, agricultural chemicals, and the like. The electronic devices include liquid crystal display devices, EL display devices, television devices (television receivers or thin television receivers), mobile phones, and the like.

When a semiconductor device 80 is provided for bills, coins, securities, documents, bearer bonds, and the like, forgery thereof can be prevented. In addition, when the semiconductor device 80 is provided for packaging containers, books, storage media, personal belongings, foods, daily commodities, electronic devices, and the like, the efficiency of an inspection system, a rental shop system, and the like can be improved. Further, when the semiconductor device 80 is provided for means of transportation, healthcare items, medicines, and the like, forgery and theft thereof can be prevented and wrong use of the medicines can be prevented. The semiconductor device 80 may be provided by, for example, being attached to the surface of an object or embedded in an object. For example, the semiconductor device 80 may be embedded in paper of a book or embedded in an organic resin of a package.

In this manner, when the semiconductor device is provided for packaging containers, storage media, personal belongings, foods, clothing, daily commodities, electronic devices, and the like, the efficiency of an inspection system, a rental shop system, and the like can be improved. In addition, when the semiconductor device is provided for means of transportation, forgery and theft thereof can be prevented. Further, when the semiconductor device is implanted in creatures such as animals, identification of the individual creature can be easily carried out. For example, when the semiconductor device is implanted in creatures such as domestic animals, not only the year of birth, sex, breed, and the like but also health conditions such as body temperature can be easily managed.

This embodiment mode can apply the configurations of the antennas and the semiconductor devices shown in other embodiment modes.

Embodiment 1

Figure 17:
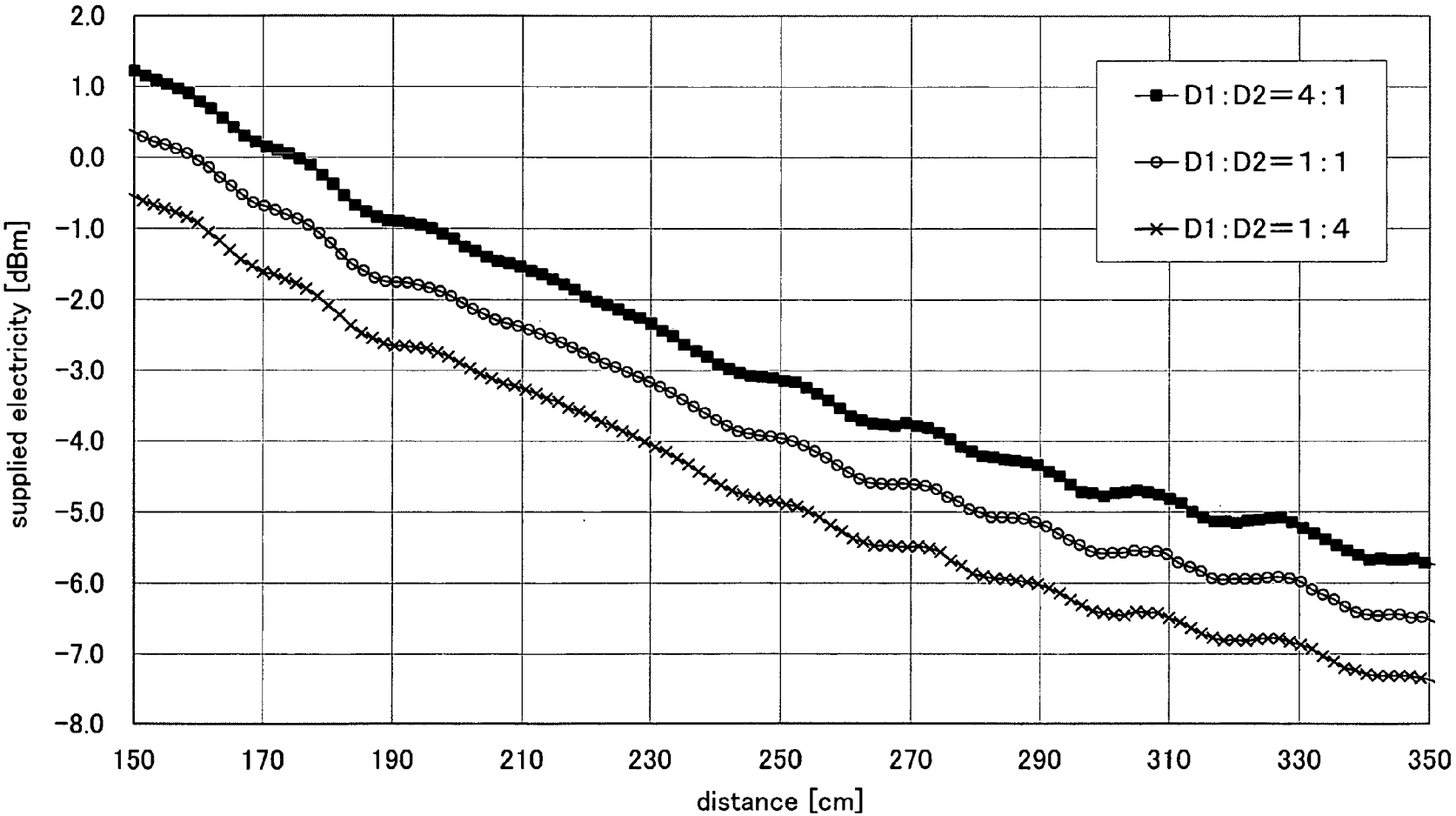
FIG. 17 illustrates Embodiment 1.

Referring again to the configuration of the foregoing embodiment mode (e.g., FIGS. 1A and 1B), this embodiment will describe simulation calculation results of the relationship between electricity supplied to the feeding section 104 and the distance between the antenna of the RFID and an antenna of a reader/writer when the relationship between the length D1 of the conductor pattern 102 and the length D2 of the conductor pattern 103 is changed. Calculation was conducted for cases where D1:D2=1:1, 4:1, and 1:4. Referring to FIG. 17, electricity supplied to the feeding section 104 when D1:D2=1:1 corresponds to a plot 401; electricity supplied to the feeding section 104 when D1:D2=4:1 corresponds to a plot 402; and electricity supplied to the feeding section 104 when D1:D2=1:4 corresponds to a plot 403.

The calculation results show that electricity supplied to the feeding section 104 when D1:D2=4:1 (the plot 402) is higher than electricity supplied to the feeding section 104 when D1:D2=1:1 (the plot 401) and D1:D2=1:4 (the plot 403). In addition, electricity supplied to the feeding section 104 when D1:D2=1:4 (the plot 403) is lower than electricity supplied to the feeding section 104 when D1:D2=1:1 (the plot 401).

The above results show that electricity supplied to the feeding section 104 can be higher when D1>D2.

Embodiment 2

Figure 18:
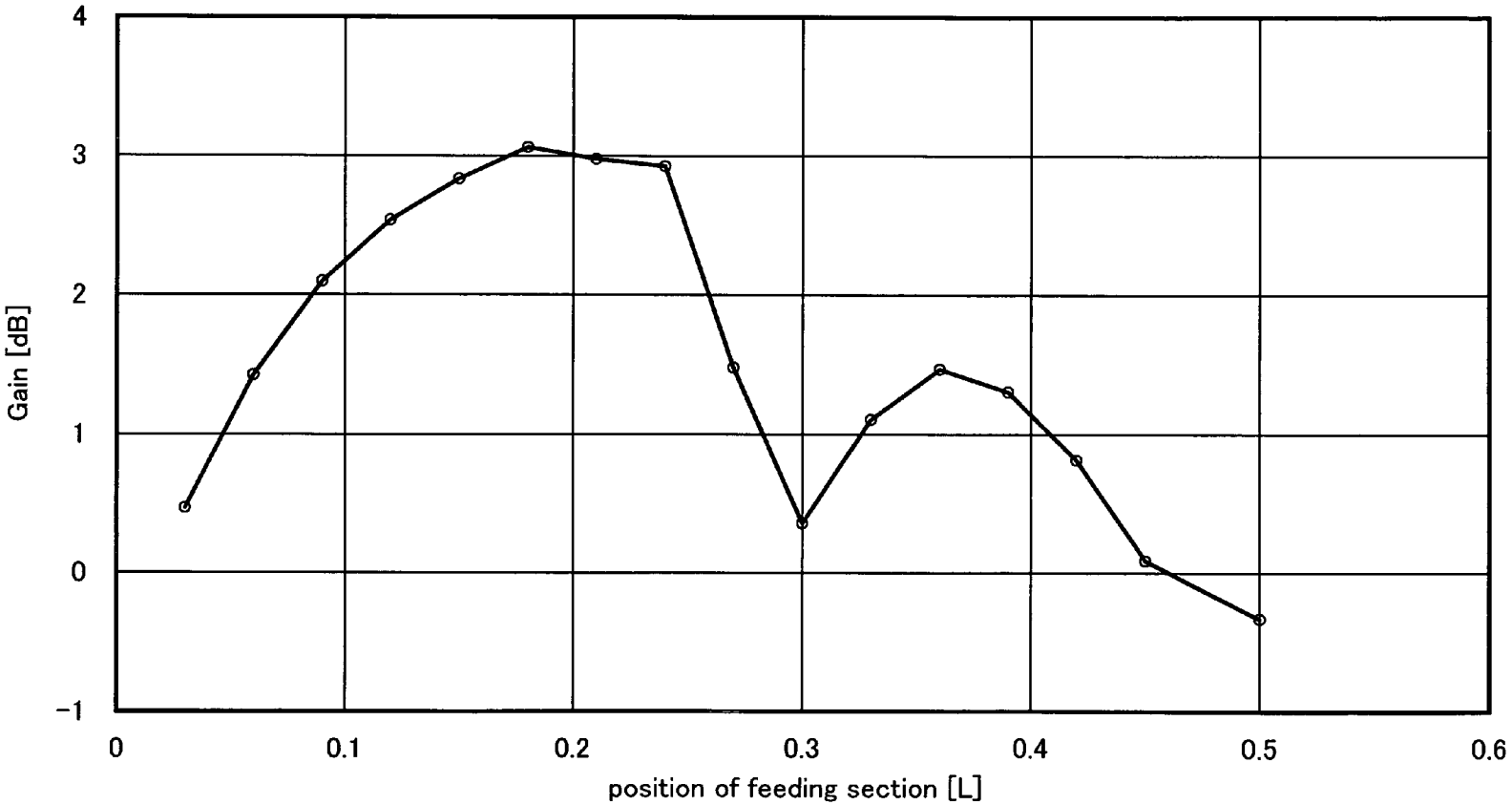
FIG. 18 illustrates Embodiment 2.

Referring again to the configuration of the foregoing embodiment mode (e.g., FIGS. 1A and 1B), this embodiment will describe simulation calculation results of the gain (the antenna gain and the loss characteristics of circularly polarized waves) when the position of the feeding section 104 on the conductor pattern 101 is changed. In FIG. 18, the X axis indicates the position of the feeding section (the distance from the cut section to the feeding section, provided that the total length of the conductor pattern 101 is L), and the Y axis indicates the remainder obtained by subtracting the loss of circularly polarized waves from the antenna gain.

The above calculation results show that regardless of the position of the feeding section 104, the antenna of the invention can obtain a higher gain as compared to the remainder obtained by subtracting the loss of circularly polarized waves from the gain of a dipole antenna. In particular, when the feeding section 104 was provided in a position in the range of L/6 (0.16 L) to L/4 (0.25 L), a sufficient antenna gain of about 3 dB could be obtained. Therefore, a large amount of electricity could be supplied to the feeding section 104 by providing the feeding section 104 in the above range.

The present application is based on Japanese Priority application No. 2006-324370 filed on Nov. 30, 2006 with the Japanese Patent Office, the entire contents of which are hereby incorporated by reference.

What is claimed is:

1. An antenna comprising:

a substrate;

a first conductor pattern over the substrate;

a second conductor pattern over the substrate;

a third conductor pattern over the substrate; and a feeding section having a first terminal and a second terminal, wherein the first conductor pattern has a loop configuration with a cut section, wherein a first end portion of the second conductor pattern and a first end portion of the third conductor pattern are connected to the first conductor pattern, wherein a second end portion of the second conductor pattern is electrically connected to the first terminal of the feeding section, wherein a second end portion of the third conductor pattern is electrically connected to the second terminal of the feeding section, wherein the total length of the second conductor pattern is longer than the total length of the third conductor pattern, and wherein the first end portion of the second conductor pattern is placed closer to the cut section than the first end portion of the third conductor pattern is.

2. The antenna according to claim 1, wherein assuming that the total length of the first conductor pattern is L, the feeding section is provided in a position whose distance from the cut section is in a range of L/6 to L/4.

3. The antenna according to claim 1, wherein the first conductor pattern, the second conductor pattern, and the third conductor pattern are formed of the same material.

4. The antenna according to claim 1, wherein the second conductor pattern and the third conductor pattern extend parallel to each other.

5. An antenna comprising:

a substrate;

a first conductor pattern over the substrate;

a second conductor pattern over the substrate;

a third conductor pattern over the substrate; and a feeding section having a first terminal and a second terminal, wherein a first end portion of the first conductor pattern is connected to the second conductor pattern, wherein a second end portion of the first conductor pattern is connected to the third conductor pattern, wherein a first end portion of the second conductor pattern is electrically connected to the first terminal of the feeding section, wherein a first end portion of the third conductor pattern is electrically connected to the second terminal of the feeding section, wherein a second end portion of the second conductor pattern and a second end portion of the third conductor pattern are insulated, wherein a conductor pattern made of the second conductor pattern and the third conductor pattern that are electrically connected through the feeding section has a loop configuration, wherein the connection portion of the first end portion of the first conductor pattern and the second conductor pattern is placed closer to the cut section than the connection portion of the second end portion of the first conductor pattern and the third conductor pattern, wherein the total length of the third conductor pattern is longer than the total length of the second conductor pattern, and wherein a distance from the connection portion of the first end portion of the first conductor pattern and the second conductor pattern to the first end portion of the second conductor pattern is longer than a distance from the connection portion of the second end portion of the first conductor pattern and the third conductor pattern to the first end portion of the third conductor pattern.

6. The antenna according to claim 5, wherein assuming that the total length of the second conductor pattern is $L_2$, the total length $L_3$ of the third conductor pattern is $3L_2$ to $5L_2$.

7. The antenna according to claim 5, wherein the first conductor pattern, the second conductor pattern, and the third conductor pattern are formed of the same material.

8. A semiconductor device comprising:

a substrate;

an integrated circuit having a first terminal and a second terminal, over the substrate; and an antenna electrically connected to the integrated circuit over the substrate, wherein the antenna includes a first conductor pattern, a second conductor pattern, and a third conductor pattern, wherein the first conductor pattern has a loop configuration with a cut section, wherein a first end portion of the second conductor pattern and a first end portion of the third conductor pattern are connected to the first conductor pattern, wherein a second end portion of the second conductor pattern is electrically connected to the first terminal of the integrated circuit, wherein a second end portion of the third conductor pattern is electrically connected to the second terminal of the integrated circuit, wherein the total length of the second conductor pattern is longer than the total length of the third conductor pattern, and wherein the first end portion of the second conductor pattern is placed closer to the cut section than the first end portion of the third conductor pattern is.

9. The semiconductor device according to claim 7, wherein assuming that the total length of the first conductor pattern is L, the integrated circuit is provided in a position whose distance from the cut section is in a range of L/6 to L/4.

10. The semiconductor device according to claim 9, wherein assuming that the total length of the second conductor pattern is $L_2$, the total length $L_3$ of the third conductor pattern is $3L_2$ to $5L_2$.

11. The semiconductor device according to claim 8, wherein the first conductor pattern, the second conductor pattern, and the third conductor pattern are formed of the same material.

12. The semiconductor device according to claim 8, wherein the integrated circuit includes a battery, the battery being wirelessly charged from outside.

13. The antenna according to claim 8, wherein the second conductor pattern and the third conductor pattern extend parallel to each other.

14. A semiconductor device comprising:

a substrate;

an integrated circuit having a first terminal and a second terminal, over the substrate; and an antenna electrically connected to the integrated circuit over the substrate, wherein the antenna includes a first conductor pattern, a second conductor pattern, and a third conductor pattern, wherein a first end portion of the first conductor pattern is connected to the second conductor pattern, wherein a second end portion of the first conductor pattern is connected to the third conductor pattern, wherein a first end portion of the second conductor pattern is electrically connected to the first terminal of the integrated circuit, wherein a first end portion of the third conductor pattern is electrically connected to the second terminal of the integrated circuit, wherein a second end portion of the second conductor pattern and a second end portion of the third conductor pattern are insulated, wherein a conductor pattern made of the second conductor pattern and the third conductor pattern that are electrically connected through the integrated circuit has a loop configuration, wherein the connection portion of the first end portion of the first conductor pattern and the second conductor pattern is placed closer to the cut section than the connection portion of the second end portion of the first conductor pattern and the third conductor pattern, wherein the total length of the third conductor pattern is longer than the total length of the second conductor pattern, and wherein a distance from the connection portion of the first end portion of the first conductor pattern and the second conductor pattern to the first end portion of the second conductor pattern is longer than a distance from the connection portion of the second end portion of the first conductor pattern and the third conductor pattern to the first end portion of the third conductor pattern.

15. The semiconductor device according to claim 14, wherein the first conductor pattern, the second conductor pattern, and the third conductor pattern are formed of the same material.

16. The semiconductor device according to claim 14, wherein the integrated circuit includes a battery, the battery being wirelessly charged from outside.

17. An antenna comprising:

a substrate;

a first conductor pattern over the substrate;

a second conductor pattern over the substrate;

a third conductor pattern over the substrate; and a feeding section having a first terminal and a second terminal, wherein the second conductor pattern extends from a first portion of the first conductor pattern, wherein the third conductor pattern extends from a second portion of the first conductor pattern, wherein the first conductor pattern has a loop configuration with a cut section, wherein an end portion of the second conductor pattern is electrically connected to the first terminal of the feeding section, wherein an end portion of the third conductor pattern is electrically connected to the second terminal of the feeding section, wherein the first portion of the first conductor pattern is placed closer to the cut section than the second portion of the first conductor pattern is, and wherein the total length of the second conductor pattern is longer than the total length of the third conductor pattern.

18. The antenna according to claim 17, wherein assuming that the total length of the first conductor pattern is L, the feeding section is provided in a position whose distance from the cut section is in a range of L/6 to L/4.

* * * * *

UNITED STATES PATENT AND TRADEMARK OFFICE

CERTIFICATE OF CORRECTION

PATENT NO. : 7,605,761 B2
APPLICATION NO. : 11/979990
DATED : October 20, 2009
INVENTOR(S) : Makoto Yanagisawa et al.

It is certified that error appears in the above-identified patent and that said Letters Patent is hereby corrected as shown below:

At column 23, line 20, "claim 7" should be --claim 8--.

Signed and Sealed this
Second Day of October, 2012

David J. Kappos

David J. Kappos
*Director of the United States Patent and Trademark Office*